US007712889B2

(12) United States Patent
Inoue

(10) Patent No.: US 7,712,889 B2
(45) Date of Patent: May 11, 2010

(54) IMAGE FORMING APPARATUS AND LIQUID REMOVAL CAPABILITY SETTING METHOD

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/392,731

(22) Filed: Feb. 25, 2009

(65) Prior Publication Data

US 2009/0160897 A1 Jun. 25, 2009

Related U.S. Application Data

(62) Division of application No. 11/390,080, filed on Mar. 28, 2006, now Pat. No. 7,517,045.

(30) Foreign Application Priority Data

Mar. 29, 2005 (JP) ..... 2005-094354
Mar. 29, 2005 (JP) ..... 2005-094355

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS 5,841,456 A 11/1998 Takei et al.
6,719,423 B2 4/2004 Chowdry et al.
6,761,446 B2 7/2004 Chowdry et al.
7,104,627 B2 9/2006 Weast
2004/0189728 A1 9/2004 Nakajima
2005/0200649 A1 9/2005 Yamaguchi et al.
2006/0164487 A1 7/2006 Kadomatsu et al.
2006/0170752 A1 8/2006 Kadomatsu et al.

FOREIGN PATENT DOCUMENTS

JP 2001-179959 A 7/2001
JP 2003136689 A 5/2003

OTHER PUBLICATIONS

Translation of JP 2001-179959 A.*

* cited by examiner

*Primary Examiner*—Matthew Luu
*Assistant Examiner*—Justin Seo
(74) *Attorney, Agent, or Firm*—Birch, Stewart, Kolasch & Birch, LLP

(57) ABSTRACT

An image forming apparatus including an ejection head which ejects liquid onto a recording medium to form a desired image thereon, a conveyance device which moves either the recording medium or the ejection head to move the recording medium in a conveyance direction relative to the ejection head, a first density determination device downstream of the ejection head in the conveyance direction which determines density of the image formed on the recording medium, a liquid removal device downstream of the first density determination device in the conveyance direction that removes liquid from the recording medium, a second density determination device downstream of the liquid removal device in the conveyance direction that determines the density of the image from which the liquid removal device liquid, and a liquid removal control device which controls the liquid removal device according to determination results of the first and second density determination devices.

8 Claims, 17 Drawing Sheets

FIG.11

200

| OHP SHEET | POSITION OF ABSORBING ROLLER (CLEARANCE FROM RECORDING MEDIUM) | ROTATIONAL SPEED OF SUCTION DEVICE |
|---|---|---|
| : | : | : |
| 2-LEVEL-DOWN (-2) | 1.2 TIMES | 0.6 TIMES |
| 1-LEVEL-DOWN (-1) | 1 TIME | 0.8 TIMES |
| DEFAULT (0) | 1 | 1 |
| 1-LEVEL-UP (+1) | 1 TIME | 1.2 TIMES |
| 2-LEVEL-UP (+2) | 0.8 TIMES | 1.4 TIMES |
| : | : | : |

FIG.12

202

| ART PAPER | POSITION OF ABSORBING ROLLER (CLEARANCE FROM RECORDING MEDIUM) | ROTATIONAL SPEED OF SUCTION DEVICE |
|---|---|---|
| : | : | : |
| 2-LEVEL-DOWN (-2) | 1.2 TIMES | 0.9 TIMES |
| 1-LEVEL-DOWN (-1) | 1.1 TIMES | 1 TIME |
| DEFAULT (0) | 1 | 1 |
| 1-LEVEL-UP (+1) | 0.9 TIMES | 1 TIME |
| 2-LEVEL-UP (+2) | 0.8 TIMES | 1.1 TIMES |
| : | : | : |

IMAGE FORMING APPARATUS AND LIQUID REMOVAL CAPABILITY SETTING METHOD

CROSS REFERENCE TO RELATED APPLICATION

This application is a Divisional of application Ser. No. 11/390,080 filed on Mar. 28, 2006, now U.S. Pat. No. 7,517,045 and for which priority is claimed under 35 U.S.C. § 120. This application also claims priority of Application No. 2005-094354 and 2005-094355 both filed in Japan on Mar. 29, 2005 under 35 U.S.C. § 119. The entire contents of all of the above applications are hereby incorporated by reference.

BACKGROUND OF THE INVENTION

1. Field of the Invention

The present invention relates to an image forming apparatus, and a liquid removal capability setting method, and more particularly, to an inkjet recording apparatus or other image forming apparatuses which form images of high quality by efficiently removing surplus liquid on a recording medium, and to a liquid removal method for same.

2. Description of the Related Art

In image forming apparatuses, such as inkjet recording apparatuses, an image is formed on a recording medium by using liquid ink in which coloring material and additives are mixed into a solvent such as water, alcohol, or the like. Liquid (ink solvent) remains on the surface of the recording medium on which the image is formed, and this can be the cause of image degradation (image defects), rear-side image transfer, cockling, and the like. In an inkjet recording apparatus, it is necessary to swiftly remove the liquid remaining on the recording medium in this way, and various means of achieving this have been devised. In particular, in systems which promote the fixing of the ink by causing the coloring material contained in the ink to become insoluble, or causing the coloring material to aggregate, by making the ink to react with a treatment liquid on the recording medium, the amount of liquid deposited onto the recording medium is high, and there is a strong need for the liquid to be removed.

Japanese Patent Application Publication No. 2001-179959 discloses an ink absorbing body and an image forming apparatus and method using the ink absorbing body, in which the ink absorbing body comprises a liquid solvent absorbing body and a separating member that covers at least partially the surface of the liquid solvent absorbing body and allows the ink solvent to pass, while having separating properties with respect to the coloring material of the ink. When ink is deposited on a sheet, the liquid solvent absorbing body is placed in closed proximity to a portion of the sheet through the separating member, and the liquid solvent is absorbed into the liquid solvent absorbing body through the separating member, in such a manner that the coloring material and the liquid solvent of the liquid ink on the sheet are mutually separated. Furthermore, there is also a composition in which a liquid volume sensor which determines the liquid volume inside a high polymer absorbing body is provided, and when the sensor value has reached a prescribed value, then a squeezing mechanism is operated.

Japanese Patent Application Publication No. 2003-136689 discloses an inkjet process including removal of excess liquid from an intermediate member, in which a primary image formed by an inkjet device is transferred to a receiving member in a transfer process zone, and in this composition, a concentrated image is formed by an image concentrating process after the primary image is formed, and a portion of the carrier liquid is removed from the concentrated image in an excess liquid removal process zone.

However, in the related art, the liquid is removed by placing an absorbing body in contact with the recording medium and pressing the absorbing body against the recording medium, and this is insufficient for handling recording media of different types, thicknesses, surface characteristics, and the like. For example, since an absorbing body is pressed against the recording medium at a prescribed pressure when removing the liquid on the recording medium, regardless of the type, thickness or surface properties of the recording medium, and the like, then in a recording medium having low surface smoothness, the ink coloring material is more liable to adhere to the absorbing body, compared to a recording medium having high smoothness, and hence there is a risk of image defects, reduced density, and a concern that coloring material which once becomes attached to the absorbing body adheres to another sheet of recording medium.

In the ink absorbing body and image forming apparatus and method using the ink absorbing body described in Japanese Patent Application Publication No. 2001-179959, and the transfer type inkjet printer described in Japanese Patent Application Publication No. 2003-136689, there is no disclosure regarding the absorption force of the ink absorbing body, or restriction of this force, and hence there is a risk of ink coloring material becoming attached to the ink absorbing body.

SUMMARY OF THE INVENTION

The present invention has been contrived in view of the foregoing circumstances, an object thereof being to provide an image forming apparatus and a liquid removal capability setting method, whereby liquid can be removed efficiently, while suppressing the adherence of the ink coloring material, or the like, to the liquid removal member, and deterioration of image quality, such as image defects, can be prevented.

In order to attain the aforementioned object, the present invention is directed to an image forming apparatus, comprising: an ejection head which ejects liquid onto a recording medium to form a desired image on the recording medium; a conveyance device which moves at least one of the recording medium and the ejection head so as to move the recording medium in a conveyance direction relatively to the ejection head; a liquid removal device which performs liquid removal to remove the liquid on the recording medium and is arranged on a downstream side of the ejection head in the conveyance direction; a determination device which determines a state after the liquid removal is performed by the liquid removal device; and a liquid removal control device which implements control to adjust a liquid removal capability of the liquid removal device according to determination results of the determination device.

According to the present invention, since the state is determined after performing the liquid removal by means of the liquid removal device for removing the liquid from the recording medium, the liquid removal capability can be adjusted on the basis of the determination results, and therefore, the liquid on the recording medium is removed by using an optimal liquid removal capability, and a desirable image can be formed on the recording medium.

The state after liquid removal by the liquid removal device may be determined by determining the state of the liquid removal member of the liquid removal device, and/or by determining the recording medium after the liquid removal (the liquid on the recording medium, or the image formed on the recording medium, or the like).

In order to attain the aforementioned object, the present invention is also directed to an image forming apparatus, comprising: an ejection head which ejects liquid onto a recording medium to form a desired image on the recording medium; a conveyance device which moves at least one of the recording medium and the ejection head so as to move the recording medium in a conveyance direction relatively to the ejection head; a liquid removal device which performs liquid removal to remove the liquid on the recording medium and is arranged on a downstream side of the ejection head in the conveyance direction; a determination device which determines a state of the liquid removal device at least after the liquid removal is performed by the liquid removal device; and a liquid removal control device which implements control to adjust a liquid removal capability of the liquid removal device according to determination results of the determination device.

According to the present invention, since the state of the liquid removal device which removes the liquid from the recording medium is determined at least after the liquid removal by the liquid removal device, in such a manner that the liquid removal capability of the liquid removal device is controlled on the basis of the determination results, then the liquid (solvent) can be removed in a suitable fashion, without removing the image forming body (for example, ink coloring material) which forms the image on the recording medium.

The liquid removal capability adjusted by the liquid removal control device includes, for example, the amount of liquid removed per unit time, and the force (pressure) applied to the liquid to be removed, and if the liquid removal capability is too large, then there is a risk that material other than the liquid may be removed from the recording medium (the surface of the recording medium), whereas if the liquid removal capability is insufficient, then there is a risk that the prescribed amount of liquid may not be removed.

The mode of determining the state of the liquid removal device by means of the determination device may include a mode in which the state before liquid removal is determined, whereupon the state after liquid removal is then also determined, in such a manner that the change in the state of the liquid removal device, before and after liquid removal, can be ascertained.

Furthermore, the liquid ejected from the ejection head may be a liquid which includes an image forming body that forms an image on the recording medium, or a liquid which reacts with a liquid containing such an image forming body and causes the image forming body to aggregate (precipitate), or the like.

The ejection head may be a line type head having a row of ejection holes of a length corresponding to the full width of the recording medium (the width of the possible image formation region of the recording medium), or a serial head which uses a short head having an ejection hole row of a length that does not reach the full width of the recording medium, and which scans this head in the breadthways direction of the recording medium.

A line ejection head may be formed to a length corresponding to the full width of the recording medium by combining short head having rows of ejection holes which do not reach a length corresponding to the full width of the recording medium, these short heads being joined together in a staggered matrix fashion.

Moreover, "recording medium" indicates a medium which receives ejection of a liquid by means of an ejection head, and this term includes various types of media, irrespective of material and size, such as continuous paper, cut paper, sealed paper, resin sheets, such as sheets for overhead projector (OHP sheets), film, cloth, and other materials.

Preferably, the determination device includes a liquid volume determination device which determines an amount of the liquid contained in the liquid removal device; and the liquid removal control device implements the control to adjust the liquid removal capability of the liquid removal device according to the determination results of the liquid volume determination device.

By determining the amount of the liquid contained in the liquid removal device, it is possible to determine the amount of liquid removed from the recording medium, and thus it can be determined that suitable liquid removal has been performed, if the amount of liquid thus determined lies within a prescribed range. On the other hand, if the amount of liquid thus determined lies outside the prescribed range, then it is determined that the amount of liquid removed has been excessive or insufficient and hence control is implemented in order to adjust the liquid removal capability.

Furthermore, it is also possible to store the determined liquid amounts and to estimate the maintenance time for the liquid removal device on the basis of the value of the amount of liquid thus stored. For example, a mode is possible in which the stored amount of liquid is added up successively, the addition result is recorded, and when the addition result exceeds a prescribed threshold value, then it is determined that the maintenance interval for the liquid removal device has been reached. After performing maintenance for the liquid removal device, desirably, the amount of liquid determination device is initialized (reset).

Preferably, the determination device includes an adhering matter determination device which determines a matter adhering to the liquid removal device; and the liquid removal control device implements the control to adjust the liquid removal capability of the liquid removal device according to the determination results of the adhering matter determination device.

If the liquid removal capability of the liquid removal device (namely, the pressing force of the absorbing member or the suction force of the suction device) is too large, then the image forming body which forms an image on the recording medium may become attached to the liquid removal device. By determining the matter adhering to the liquid removal device in this way, it is possible to determine whether or not the liquid removal has been carried out satisfactorily. If the adhering matter determination device determines that there is matter adhering to the liquid removal device, then control is implemented in order to lower the liquid removal capability.

A desirable mode is one in which a cleaning device is provided for carrying out cleaning of the liquid removal device, and cleaning of the liquid removal device is carried out before determining the adhering matter, if adhering matter is determined to be present on the liquid removal device. This adhering matter may also include matter in a solid state, such as the image forming body, or in a liquid (solvent), or semi-solid state. Furthermore, it may also include liquid that has permeated into the liquid removing member.

In order to attain the aforementioned object, the present invention is also directed to an image forming apparatus, comprising: an ejection head which ejects liquid onto a recording medium to form a desired image on the recording medium; a conveyance device which moves at least one of the recording medium and the ejection head so as to move the recording medium in a conveyance direction relatively to the ejection head; a first density determination device which determines density of the image formed on the recording medium and is arranged on a downstream side of the ejection head in the conveyance direction; a liquid removal device which performs liquid removal to remove the liquid on the recording medium and is arranged on a downstream side of the first density determination device in the conveyance direction; a second density determination device which determines the density of the image from which a portion of the liquid has been removed by the liquid removal device, the second density determination device being arranged on a downstream side of the liquid removal device in the conveyance direction; and a liquid removal control device which implements control to adjust a liquid removal capability of the liquid removal device according to determination results of the first density determination device and the second density determination device.

According to the present invention, since the first density determination device and the second density determination device are provided for determining the density of the image on the recording medium, respectively, at positions before and after the liquid removal device which removes the liquid from the recording medium (namely, on the upstream side and the downstream side of the liquid removal device in terms of the conveyance direction of the recording medium), and since the density before the liquid removal from the image formed on the recording medium, and the density after the liquid removal are determined and control is implemented in such a manner that the liquid removal capability of the liquid removal device to is adjusted on the basis of these determination results, then the liquid (solvent) is removed in a suitable fashion, without removing the image forming body (for example ink coloring material) which forms the image on the recording medium.

The density of the image determined by the first density determination device and the second density determination device includes the intensity of the color of the dots which form the image. In other words, if the intensity of the color after the liquid removal from dots formed on the recording medium is weak compared to the intensity of the color before the liquid removal, then it is possible to determine that a portion of the image forming body which forms the dots has been removed when removing the liquid. If the portion of the image forming body is removed, then it is determined that the liquid removal capability is excessive, and control is implemented in such a manner that the liquid removal capability is reduced.

Preferably, the image forming apparatus further comprises: a processing device which calculates a density difference between the density of the image after the liquid removal as obtained by the second density determination device and the density of the image before the liquid removal as obtained by the first density determination device, wherein the liquid removal control device implements the control to adjust the liquid removal capability of the liquid removal device according to the density difference calculated by the processing device.

In the processing device, the density difference between the density of the image determined by the first density determination device and the density of the image determined by the second density determination device is found. This relative density difference may be the difference between the determination result of the second density determination device and the determination result of the first density determination result, or it may be the ratio of the determination result of the first density determination device with respect to the determination result of the second density determination device.

When the density of the image before the liquid removal is determined by the first density determination device, desirably, correction is implemented to account for the effect that the liquid on the recording medium has on the determination results.

Preferably, the image forming apparatus further comprises: a recording medium determination device which determines a type of the recording medium, wherein the liquid removal control device implements the control to adjust the liquid removal capability of the liquid removal device according to the type of the recording medium determined by the recording medium determination device.

Since the liquid removal capability of the liquid removal device is controlled in accordance with the type of the recording medium, then desirable liquid removal is carried out in accordance with the type of the recording medium.

The type of the recording medium is determined on the basis of factors such as the surface properties (flatness) and the thickness of the recording medium, and the like. For example, there is a mode in which control is implemented in order to move the position of the liquid removal device during liquid removal, in accordance with the thickness of the recording medium.

The mode of determining the type of the recording medium by the recording medium determination device may involve the user inputting information about the recording medium, or alternatively, the recording medium may be read in directly by means of a determination device, such as a sensor or imaging element, the type of the recording medium being determined automatically on the basis of the results thus read in. Furthermore, it is also possible to adopt a composition in which an information recording body (memory, IC tag, or the like) which stores information including information on the recording medium is provided in the supply device which supplies the recording medium, in such a manner that the type of the recording medium (recording medium type) is read in from this information recording body.

Preferably, the image forming apparatus further comprises: a maximum ejection region determination device which determines a maximum ejection region where a liquid ejection volume is a maximum on the image, according to data of the image to be formed on the recording medium; and an image formation control device which implements control to carry out image formation from a trailing edge side of the image to a leading edge side thereof in the conveyance direction, if the maximum ejection region is situated a side of the trailing edge from a central region of the image.

If the region where the liquid ejection volume is the maximum in the image formed on the recording medium is situated to the trailing edge side of the central region of the image in terms of the conveyance direction, then the image is formed from the trailing edge side toward the leading edge side in terms of the conveyance direction, in such a manner that the region of the maximum ejection volume is located in the first half of the image formation operation. Therefore, the liquid removal set to the optical liquid removal capability is carried out at least in the second half of the image formation operation. This type of control has particularly beneficial effects in the case of single-pass systems which form the image by scanning the recording medium with the ejection head just once.

The mode of forming an image from the trailing edge side toward the leading edge side in terms of the conveyance direction includes a mode where the image is rotated through 180 degrees.

Preferably, the liquid removal device comprises a suction device which suctions the liquid; and the liquid removal control device implements the control to adjust the liquid removal capability of the liquid removal device by adjusting a suction force of the suction device.

Since the liquid removal capability of the liquid removal device is adjusted by altering the suction force of the suction device which suctions the liquid removed from the recording medium by the liquid removal device, then it is possible to remove the liquid from the recording medium in a highly efficient manner, by means of a simple control procedure.

A suction pump is suitable for use as the suction device. The suction force can be raised by increasing the rotational speed of the suction pump, and the suction force can be reduced by lowering the rotational speed. In other words by adjusting the rotational speed of the suction pump, the negative pressure applied to the liquid on the recording medium can be adjusted.

Alternatively, it is also preferable that: the liquid removal device comprises: an absorption device which absorbs and removes the liquid on the recording medium by making contact with the liquid on the recording medium; and a movement device which moves the absorption device in a direction having a component in a direction substantially perpendicular to a recording surface of the recording medium; and the liquid removal control device implements the control to adjust the liquid removal capability of the liquid removal device by adjusting a pressing force of the absorption device against the recording medium by adjusting a position of the absorption device by the movement device.

The liquid removal device includes the absorption device which absorbs the liquid by making contact with the liquid on the recording medium, and the pressing force of this absorption device against the recording medium can be altered by moving the absorbing member in the direction having a component that is substantially perpendicular to the recording surface of the recording medium. Therefore, the liquid removal capability of the absorbing device is controlled by varying the pressing force of the absorbing device, and therefore, highly efficient liquid removal becomes possible by means of a simple composition.

For the absorbing device, it is desirable to use a member which absorbs the liquid by means of capillary action, such as a porous member, nonwoven cloth, or the like.

In order to attain the aforementioned object, the present invention is also directed to an inkjet recording apparatus, comprising the above-described image forming apparatus.

Preferably, the ejection head includes: an inkjet head which ejects ink forming the image onto the recording medium; and a treatment liquid ejection head which ejects treatment liquid which fixes the ink on the recording medium by reacting with the ink.

In a two-liquid type of inkjet recording apparatus which promotes the fixing of the ink by causing the treatment liquid to react with the ink, unreacted ink (ink solvent) and surplus treatment liquid are removed efficiently, and furthermore, desirable liquid removal is achieved, without removing the ink coloring material. Particularly beneficial effects can be obtained in a two-liquid type of inkjet recording apparatus, which ejects a large amount of liquid (solvent) onto the recording medium.

In order to attain the aforementioned object, the present invention is also directed to a liquid removal capability setting method, comprising: an image formation step of ejecting liquid onto a recording medium to form a desired image on the recording medium; a liquid removal step of removing the liquid on the recording medium by means of a liquid removal device, after the image formation step; a state determination step of determining a state after the liquid removal step; and a liquid removal capability adjusting step of adjusting a liquid removal capability of the liquid removal device according to determination results in the state determination step.

In order to attain the aforementioned object, the present invention is also directed to a liquid removal capability setting method, comprising: an image formation step of ejecting liquid onto a recording medium to form a desired image on the recording medium; a liquid removal step of removing the liquid on the recording medium by means of a liquid removal device, after the image formation step; a state determination step of determining a state of the liquid removal device after the liquid removal step; and a liquid removal capability adjusting step of adjusting a liquid removal capability of the liquid removal device according to determination results in the state determination step.

It is also possible to include a determination step before the liquid removal, which determines the state of the liquid removal device before the liquid removal, between the image forming step and the liquid removal step, and the liquid removal capability of the liquid removal device may be adjusted on the basis of the change between the state of the liquid removal device after the liquid removal and the state of the liquid removal device before the liquid removal.

Desirably, a cleaning step is included in order to clean the liquid removal device before implementing the liquid removal step. Furthermore, a desirable mode is one which includes an initial value setting step of setting the initial value (default value) of the liquid removal capability.

Preferably, a test image is formed on the recording medium in the image formation step.

Since the test image is formed on the recording medium and the suitability or unsuitability of the liquid removal capability is determined on the basis of the liquid removal results in the test image, then desirable liquid removal is always achieved in the actual image.

In order to attain the aforementioned object, the present invention is also directed to a liquid removal capability setting method, comprising: an image formation step of ejecting liquid onto a recording medium from an ejection head to form a desired image on the recording medium while moving at least one of the recording medium and the ejection head so as to move the recording medium in a conveyance direction relatively to the ejection head; a first density determination step of determining density of the image formed on the recording medium; a liquid removal step of removing the liquid on the recording medium by means of a liquid removal device, after the first density determination step; a second density determination step of determining the density of the image from which a portion of the liquid has been removed by the liquid removal device, after the liquid removal step; and a liquid removal capability adjusting step of adjusting a liquid removal capability of the liquid removal device according to determination results in the first density determination step and the second density determination step.

Since desirable liquid removal is achieved, with the liquid removal capability being set on the basis of the density of the image before and after the liquid removal step, then it is possible to obtain a desirable image which does not produce deterioration of the image due to the liquid removal process.

Preferably, an actual image is formed on the recording medium in the image formation step.

Since the liquid removal is carried out by setting the liquid removal capability to an optimal value during actual image formation, it is possible to obtain a desirable image without lowering the productivity rate.

Preferably, the liquid removal capability setting method further comprises: a maximum ejection region determination step of determining a maximum ejection region where a liquid ejection volume is a maximum on the image, according to data of the image to be formed on the recording medium; and an image formation control step of implementing control in the image formation step to carry out image formation from a trailing edge side of the image to a leading edge side thereof in the conveyance direction, if the maximum ejection region is situated a side of the trailing edge from a central region of the image.

The image forming step may include an image processing step of performing image processing for rotating the image through 180 degrees, if the region of the maximum ejection volume is situated toward the trailing edge side of the image from the central region of the image.

According to the present invention, the state of the liquid removal device is determined, and the liquid removal capability is adjusted in the liquid removal device, in accordance with this determination result. Therefore, liquid removal is achieved, in which an optimal liquid removal capability is set in accordance with the state of the liquid removal device.

Furthermore, since the state of the liquid removal device which removes liquid from the recording medium is determined and the liquid removal capability, such as the suction force of the suction device or the pressing force of the liquid removal device, with respect to the recording medium, is controlled according to the determination results, then desirable liquid removal is carried out, without removing the image forming body which forms the image on the recording medium.

Furthermore, since a first density determination device for determining the density of the image before liquid removal and a second density determination device for determining the density of the image after liquid removal are provided, in such a manner that the liquid removal capability of the liquid removal device is adjusted on the basis of the determination results obtained from the first density determination device and the second density determination device, then desirable liquid removal is achieved, in which an optimal liquid removal capability is set in accordance with the determination results.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 11 is a diagram showing an example of an absorption force table;

FIG. 12 is a diagram showing a further example of an absorption force table;

DETAILED DESCRIPTION OF THE PREFERRED EMBODIMENTS

First Embodiment

General Composition of Inkjet Recording Apparatus

Figure 1:
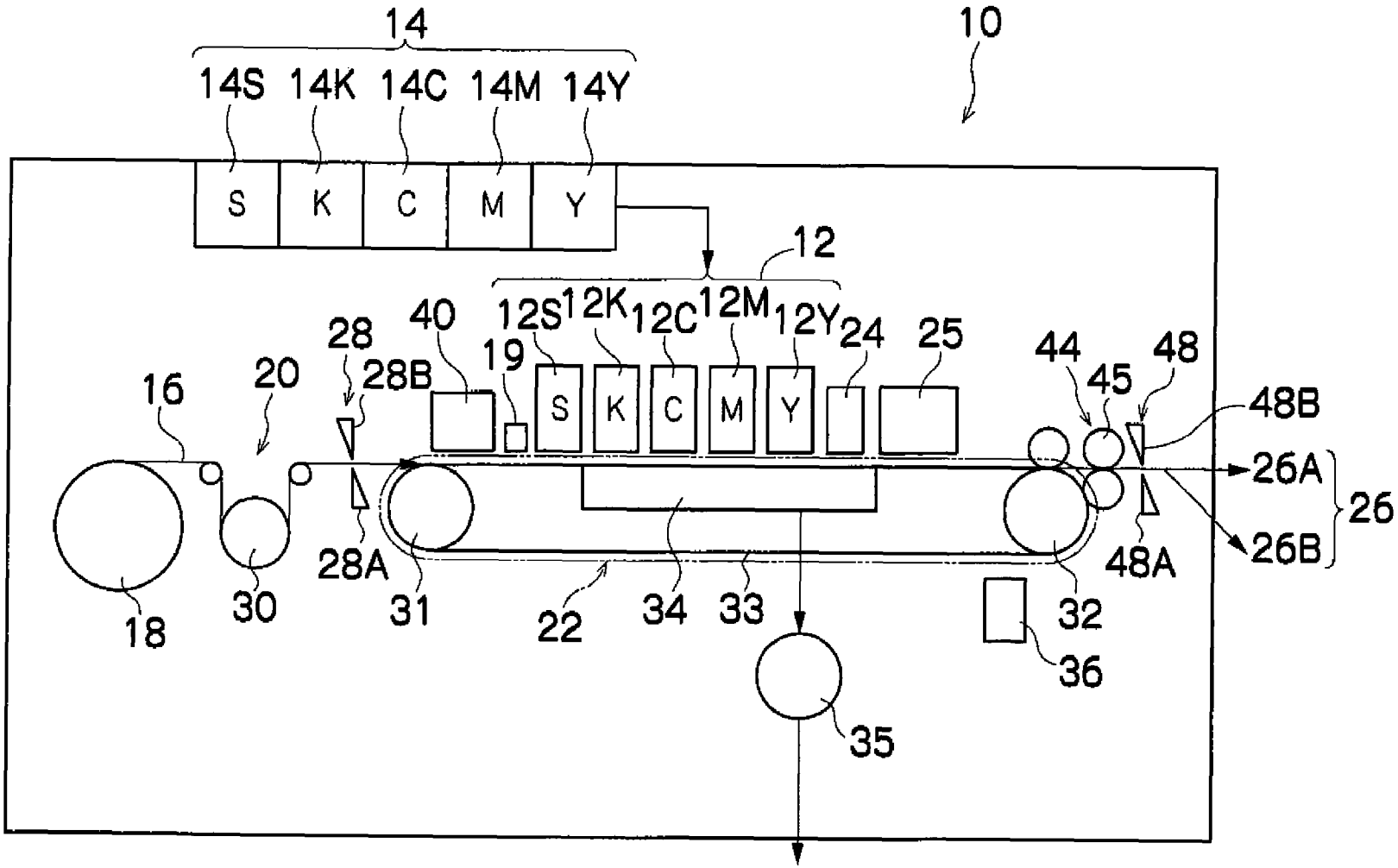
FIG. 1 is a general compositional diagram of an inkjet recording apparatus according to a first embodiment of the present invention.

FIG. 1 is a diagram of the general composition of an inkjet recording apparatus according to an embodiment of the present invention. As shown in FIG. 1, this inkjet recording apparatus 10 comprises: a print unit 12 having a plurality of print heads 12K, 12C, 12M and 12Y provided for respective inks of the colors black (K), cyan (C), magenta (M) and yellow (Y) and a treatment liquid ejection head 12S, which ejects treatment liquid promoting the fixing of the ink by reacting with the ink (hereinafter, the print heads 12K, 12C, 12M and 12Y and the treatment liquid ejection head 12S are referred to generally as the heads 12A, 12K, 12C, 12M and 12Y); a storing and loading unit 14 which stores the color inks corresponding to the print heads 12K, 12C, 12M and 12Y, and the treatment liquid corresponding to the treatment liquid ejection head 12S; a paper supply unit 18, which supplies a recording medium 16; a recording medium determination unit 19, which determines the type of recording medium 16; a decurling unit 20, which removes curl in the recording medium 16; a suction belt conveyance unit 22, disposed opposing the ink ejection surface of the print unit 12, which conveys the recording medium 16 while keeping the recording medium 16 flat; a print determination unit 24, which reads out the print result created by the print unit 12; a liquid removal unit 25, disposed after the print determination unit 24, which removes liquid (solvent) on the recording medium 16; and a paper output unit 26, which outputs the printed recording medium 16 (printed matter) to the exterior.

In FIG. 1, a magazine for rolled paper (continuous paper) is shown as an example of the paper supply unit 18; however, more magazines with paper differences such as paper width and quality may be jointly provided. Moreover papers may be supplied with cassettes that contain cut papers loaded in layers and that are used jointly or in lieu of the magazine for rolled paper.

In the case of the configuration in which roll paper is used, a cutter (a first cutter) 28 is provided as shown in FIG. 1, and the continuous paper is cut to a desired size by the cutter 28. The cutter 28 has a stationary blade 28A, whose length is not less than the width of the conveyor pathway of the recording medium 16, and a circular blade 28B, which moves along the stationary blade 28A. The stationary blade 28A is disposed on the reverse side of the printed surface of the recording medium 16, and the circular blade 28B is disposed on the side adjacent to the printed surface across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The inkjet recording apparatus 10 is provided with the recording medium determination unit 19, which determines the type of recording medium 16, on the upstream side of the print unit 12. Although described in more detail later (see FIG. 3), the recording medium determination unit 19 comprises a thickness sensor, which determines the thickness of the recording medium 16, and a surface characteristics sensor, which determines the surface characteristics (smoothness) of the recording medium 16. The thickness sensor and the surface characteristics sensor are not shown in FIG. 1, but are denoted with the reference numerals 120 and 122 in FIG. 3. If the above-described information recording body contains the information such as thickness information and surface characteristics information relating to the recording medium 16 to be obtained by the recording medium determination unit 19, then the recording medium determination unit 19 can be omitted.

The recording medium 16 delivered from the paper supply unit 18 retains curl due to having been loaded in the magazine. In order to remove the curl, heat is applied to the recording medium 16 in the decurling unit 20 by a heating drum 30 in the direction opposite from the curl direction in the magazine. The heating temperature at this time is preferably controlled so that the recording medium 16 has a curl in which the surface on which the print is to be made is slightly round outward.

The decurled and cut recording medium 16 is delivered to the suction belt conveyance unit 22. The suction belt conveyance unit 22 has a configuration in which an endless belt 33 is set around rollers 31 and 32 so that the portion of the endless belt 33 facing at least the ink (treatment liquid) ejection face of the printing unit 12 and the sensor face of the print determination unit 24 forms a horizontal plane (flat plane).

The belt 33 has a width that is greater than the width of the recording medium 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording medium 16 on the belt 33 is held by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording medium 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a liquid absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the above-described suction belt conveyance is preferable, in which nothing comes into contact with the image surface in the printing area where the recording medium 16 opposes the heads 12S, 12K, 12C, 12M and 12Y and receives ejected droplets of the treatment liquid and the ink.

A heating fan 40 is disposed on the upstream side of the printing unit 12 in the conveyance pathway formed by the suction belt conveyance unit 22. The heating fan 40 blows heated air onto the recording medium 16 to heat the recording medium 16 immediately before printing so that the ink deposited on the recording medium 16 dries more easily.

Figure 2:
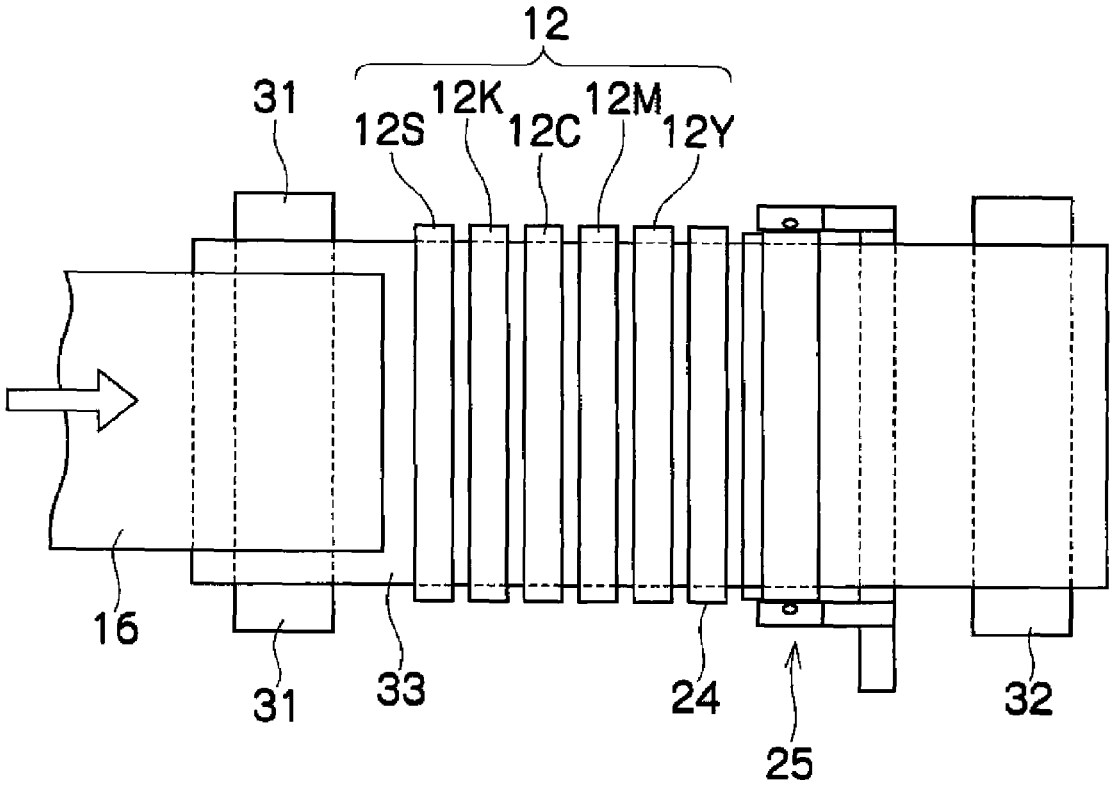
FIG. 2 is a principal plan diagram of the peripheral area of a print unit in the inkjet recording apparatus shown in FIG. 1.

The print unit 12 is a so-called "full line head" in which a line head having a length corresponding to the maximum paper width is arranged in a direction that is perpendicular to the paper feed direction (see FIG. 2). An example of the detailed structure is described later, and each of the heads 12S, 12K, 12C, 12M, and 12Y is constituted by a line head, in which a plurality of nozzles are arranged along a length that exceeds at least one side of the maximum-size recording medium 16 intended for use in the inkjet recording apparatus 10, as shown in FIG. 2.

The heads are arranged in the order of the treatment liquid ejection head 12S corresponding to the treatment liquid (S), and the print heads 12K, 12C, 12M, and 12Y corresponding to the respective color inks of black (K), cyan (C), magenta (M), and yellow (Y) from the upstream side, following the feed direction of the recording medium 16 (hereinafter, referred to as the paper feed direction). A color print can be formed on the recording medium 16 by ejecting treatment liquid from the treatment liquid ejection head 12S and by ejecting color inks respectively from the print heads 12K, 12C, 12M, and 12Y, onto the recording medium 16 onto which treatment liquid has been deposited (in other words, onto the treatment liquid), while conveying the recording medium 16.

The print unit 12, in which the full-line heads covering the entire width of the paper are thus provided for the respective ink colors, can record an image over the entire surface of the recording medium 16 by performing the action of moving the recording medium 16 and the print unit 12 relatively to each other in the sub-scanning direction just once (in other words, by means of a single sub-scan). Higher-speed printing is thereby made possible and productivity can be improved in comparison with a shuttle type head configuration in which a head moves reciprocally in the main scanning direction.

Although a configuration with the KCMY four standard colors is described in the present embodiment, the combinations of the ink colors and the number of colors are not limited to these, and light and/or dark inks can be added as required. For example, a configuration is possible in which print heads for ejecting light-color inks such as light cyan and light magenta are added.

As shown in FIG. 1, the storing and loading unit 14 comprises a treatment liquid tank 14S, which stores the treatment liquid corresponding to the treatment liquid ejection head 12S, and ink supply tanks 14K, 14C, 14M and 14Y, which store color inks corresponding to the respective print heads 12K, 12C, 12M, 12Y. The tanks are connected to the heads 12S, 12K, 12C, 12M and 12Y, through prescribed tubing channels (not shown).

Furthermore, the ink storing and loading unit 14 also comprises a warning device (for example, a display device or an alarm sound generator) for warning when the remaining amount of any of treatment liquid and ink is low, and has a mechanism for preventing loading errors between inks of different colors and between the inks and treatment liquid.

The print determination unit 24 has an image sensor for capturing an image of the print result of the printing unit 12, and functions as a device to check for ejection defects such as clogs of the nozzles in the printing unit 12 from the image read by the image sensor.

The print determination unit 24 of the present embodiment is configured with at least a line sensor having rows of photoelectric transducing elements with a width that is greater than the width (printable width) of the treatment liquid and ink ejection of the heads 12S, 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12S, 12K, 12C, 12M, and 12Y, and the ejection of each heads 12S, 12K, 12C, 12M, and 12Y is determined. The ejection determination includes the presence of the ejection, measurement of the dot size, and measurement of the dot deposition position.

The liquid removal unit 25, which removes the un-reacted treatment liquid remaining on the recording medium 16 and the ink solvent remaining on the recording medium 16, is disposed at a stage after the print determination unit 24 (on the downstream side thereof in terms of the paper feed direction). The details of the liquid removal unit 25 are described later.

A heating and pressurizing unit 44 is provided at a stage following the liquid removal unit 25. The heating and pressurizing unit 44 is a device which dries the recording medium 16 and serves to control the luster of the image surface. It applies pressure to the image surface by means of pressure rollers 45 having prescribed surface indentations, while heating same, and hence an undulating form is transferred to the image surface.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The printed matter generated in this manner is output from the paper output unit 26. The target print and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Description of Liquid Removal Unit

Figure 3:
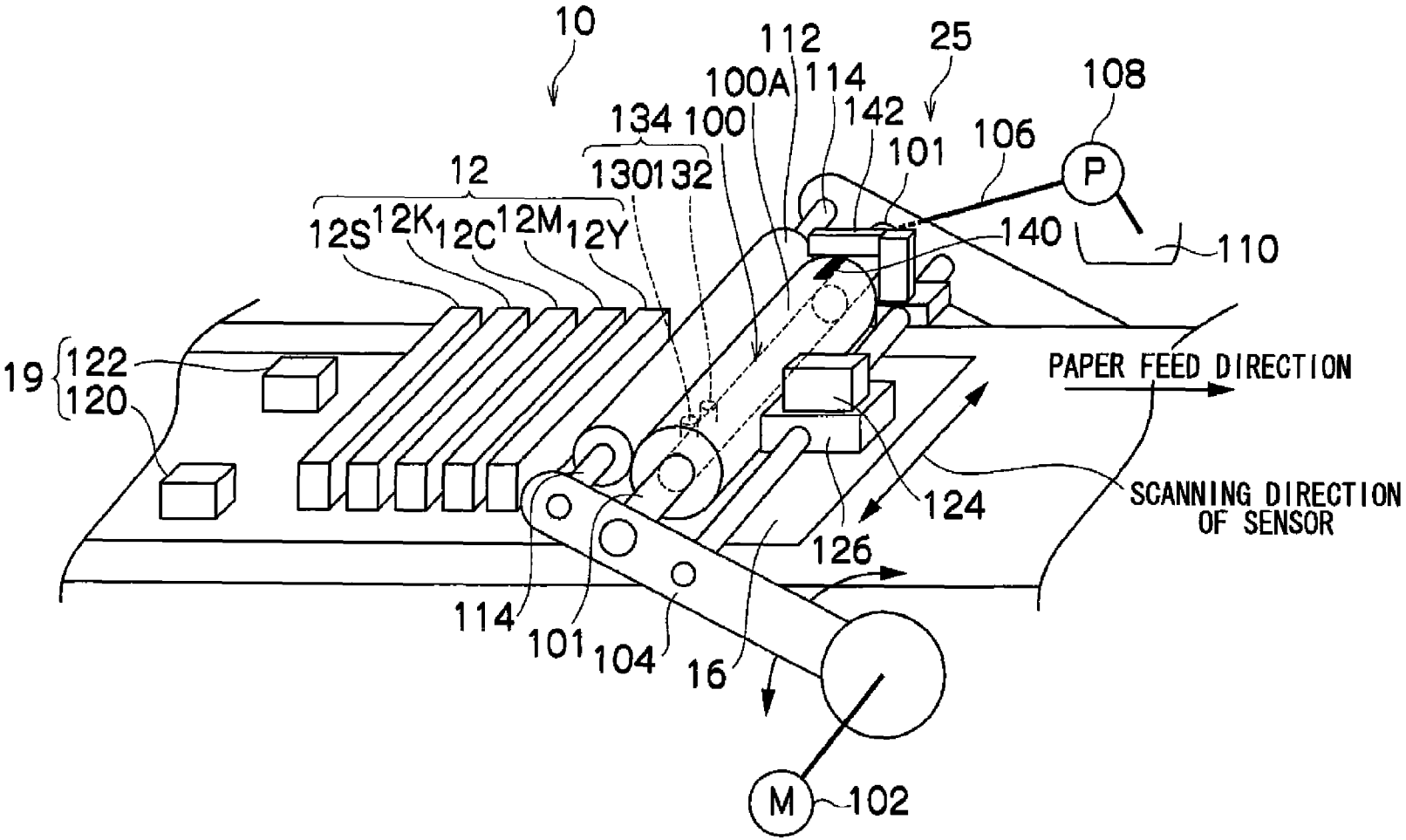
FIG. 3 is a principal schematic drawing of a liquid removal unit in the inkjet recording apparatus shown in FIG. 1.

Next, the liquid removal unit 25 is described in detail with reference to FIG. 3. FIG. 3 is a principal schematic drawing of the liquid removal unit 25.

As shown in FIG. 3, the liquid removal unit 25 comprises: an absorbing roller 100 having a length corresponding to the breadthways dimension of the recording medium 16 in the direction substantially perpendicular to the paper feed direction (a length substantially equal to or greater than the full width of the recording medium 16); a pressing arm 104, which supports the absorbing roller 100 through a supporting member 101 coupled to both ends of the absorbing roller 100 and is driven by a drive source 102 so as to vary the distance between the absorbing roller 100 and the recording medium 16 (in such a manner that the absorbing roller 100 is moved in a substantially perpendicular direction to the recording surface of the recording medium 16); a suction device (pump) 108, which suctions the liquid absorbed by the absorbing roller 100 (and accommodated inside the absorbing roller 100), through a tube 106; a liquid receptacle 110, which receives the liquid suctioned from the absorbing roller 100 through the suction device 108; and a cleaning roller 112, which abuts against the absorbing roller 100 and removes ink coloring material and foreign matter adhering to the surface of the absorbing roller 100, and liquid in the vicinity of the surface of absorbing roller 100.

The absorbing roller 100 has a liquid contacting section 100A, which makes contact with the liquid on the recording medium 16 and is made of a member having excellent liquid absorbing properties, such as a nonwoven cloth, a hydrophilic porous member, polyvinyl alcohol (PVA), polyurethane-type material, or the like, and the liquid on the recording medium 16 (principally, the ink solvent and the treatment liquid solvent) is absorbed and removed by capillary action.

The absorbing roller 100 is connected to the suction device 108 through the tube 106. By operating this suction device 108 and generating a negative pressure in the hollow portion provided in the absorbing roller 100, the liquid suctioned and removed from the recording medium 16 by the absorbing roller 100 is expelled to the liquid receptacle 110.

The absorbing roller 100 is constituted rotatably about an axis of rotation formed by the supporting member 101, by means of a rotating mechanism (not shown). More specifically, when executing liquid removal, the absorbing roller 100 is rotated while the absorbing roller 100 makes contact with the liquid on the recording medium 16 (or with the recording medium 16 itself).

For the drive source 102 which drives the pressing arm 104 that varies the pressure of the absorbing roller 100 (the position of the absorbing roller 100 in the thickness direction of the recording medium 16), it is suitable to use a motor compatible with positional control (control of the amount of rotation), such as a stepping motor, servo motor, or the like. The amount of movement of the pressing arm 104 is controlled by governing the drive signal supplied to the drive source 102, and the distance (clearance) between the absorbing roller 100 and the recording medium 16 is varied.

If the thickness of the recording medium 16 changes, or the pressure applied to the recording medium 16 by the absorbing roller 100 is altered, or the like, then the distance between the absorbing roller 100 and the recording medium 16 is varied. The term that "the distance between the absorbing roller 100 and the recording medium 16 is varied" includes that the absorbing roller 100 is moved from a state in which it makes contact with the surface of the recording medium 16 (and more specifically, a state where the distance between the absorbing roller 100 and recording medium 16 is zero) further toward the recording medium 16 (namely, pressing the absorbing roller 100 against the recording medium 16 with a prescribed pressure). In other words, taking the distance in the direction in which the absorbing roller 100 is moved away from the recording medium 16, with reference to the position at which the absorbing roller 100 makes contact with the recording medium 16, to be the positive direction, it is also possible to drive the drive source 102 in such a manner that the absorbing roller 100 is moved in the negative direction.

It is also possible to compose the liquid contacting section 100A of the absorbing roller 100 by means of a hollow member made of metal, resin, or the like, having a plurality of holes (absorption holes) so that the liquid on the recording medium 16 is suctioned and removed by generating a negative pressure in the hollow section by means of the suction device 108. In a mode where the liquid on the recording medium 16 is suctioned and removed in this manner, it is possible to control the volume of liquid removed by the absorbing roller 100 per unit time, by altering the negative pressure generated by the suction device 108.

In other words, the liquid volume removed per unit time by the absorbing roller 100 increases when the absolute value of the negative pressure generated by the suction device 108 is raised, whereas when the absolute value of the negative pressure is reduced, then the liquid volume removed per unit time by the absorbing roller 100 is reduced.

The cleaning roller 112 has substantially the same length as the absorbing roller 100 in the breadthways direction of the recording medium 16, and either end section thereof is supported by the pressing arm 104 through the supporting member 114. If a porous member, or the like, is used for the liquid contacting section 100A of the absorbing roller 100, then a member having greater permeability than the liquid contacting section 100A is used for the cleaning roller 112.

The cleaning roller 112 is constituted in such a manner that it can be moved between a cleaning position where it makes contact with the absorbing roller 100, and a withdrawal position where it does not make contact with the absorbing roller 100, by means of a movement mechanism (not shown). When carrying out the cleaning of the absorbing roller 100, the cleaning roller 112 is moved to the cleaning position, and when not carrying out the cleaning of the absorbing roller 100, the cleaning roller 112 is moved to the withdrawal position. Furthermore, the cleaning roller 112 is composed in such a manner that it can idly rotate about the supporting member 114, which forms an axis of rotation.

In a case where a metal member or resin member having a plurality of absorbing holes is used in the liquid contacting section 100A of the absorbing roller 100, then a blade-shaped member can be used instead of the cleaning roller, and the liquid and solid matter, such as ink coloring material, attached to the surface of the liquid contacting section 100A can be removed by sliding this blade over the liquid contacting section 100A.

The thickness sensor 120, which measures the thickness of the recording medium 16, and the surface characteristics sensor 122, which determines the surface characteristics of the recording medium 16, are arranged on the upstream side of the absorbing roller 100 in terms of the paper feed direction. The thickness sensor 120 and the surface characteristics sensor 122 are incorporated into the recording medium determination unit 19 shown in FIG. 1. It is possible to use commonly known technology for the method of measuring the thickness and determining the surface characteristics of the recording medium 16 (the surface smoothness of the recording medium 16), by means of the thickness sensor 120 and the surface characteristics sensor 122. For example, in order to determine the surface characteristics of the recording medium 16, a mode is possible which uses a sensor having a light emitting section that irradiates light onto the recording medium 16 and a light receiving section that receives reflected light from the recording medium 16, the surface characteristics of the recording medium 16 being determined on the basis of the information, such as the light quantity and wavelength, measured by the light receiving section.

On the other hand, a soiling sensor 124, which detects ink coloring material, foreign matter, or the like, adhering to the surface of the absorbing roller 100, and a carriage 126, which moves the soiling sensor 124 in the lengthwise direction of the absorbing roller 100, are provided on the downstream side of the absorbing roller 100 in terms of the paper feed direction. The soiling sensor 124 has a width that is shorter than the length of the absorbing roller 100 in its lengthwise direction, and by moving the carriage 126 through the full range of the absorbing roller 100 in the lengthwise direction, in line with this lengthwise direction, it is possible to scan the whole region of the absorbing roller 100 to detect adhering matter (soiling) that has become attached to the surface of the absorbing roller 100. A commonly known technique is used for the method of detecting adhering matter on the surface of the absorbing roller 100, by means of the soiling sensor 124. For example, a mode is possible which uses a light-emitting element that irradiates a prescribed light onto the surface of the absorbing roller 100, and a light receiving section that receives the reflected light reflected by the surface of the absorbing roller 100, thereby determining the presence or absence of the adhering matter on the surface of the absorbing roller 100, on the basis of the difference between the reflectivity of the surface of the absorbing roller 100 and the adhering matter.

FIG. 3 shows the mode in which adhering matter is detected throughout the full width of the absorbing roller 100 by scanning with the soiling sensor 124 having a width that is shorter than that of the absorbing roller 100. However, it is also possible to provide a soiling sensor 124 having a width corresponding to the width of the absorbing roller 100.

Furthermore, the absorbing roller 100 is provided with a liquid volume measurement unit 150 (not shown in FIG. 3, but shown in FIG. 7), which measures the amount of liquid contained in the absorbing roller 100. The liquid volume measurement unit 150 is constituted by a liquid content sensor 134 having a pair of electrodes 130 and 132 disposed inside the absorbing roller 100, and information (a signal) relating to the amount of liquid contained in the absorbing roller 100 is estimated on the basis of the resistance value between the electrodes 130 and 132 obtained from the liquid content sensor 134.

As shown in FIG. 3, a phase determination mark 140 is provided at the rotational position (phase) of the absorbing roller 100 where the liquid content sensor 134 is provided, in such a manner that the phase of the absorbing roller 100 in the rotational direction can be determined by using a phase determination sensor 142 provided on the main body. More specifically, when determining the amount of liquid in the absorbing roller 100, the absorbing roller 100 is rotated so that it is aligned in phase with the liquid content sensor 134. The liquid content measured by the liquid content sensor 134 includes any solvent (e.g., water, alcohol, or the like) which may be contained in the ink solvent and treatment liquid.

Structure of Head

Next, the structure of the heads 12S, 12K, 12C, 12M, and 12Y is described. The heads 12S, 12K, 12C, 12M and 12Y have the same structure, and a reference numeral 50 is hereinafter designated to any of the heads.

Figure 4A:
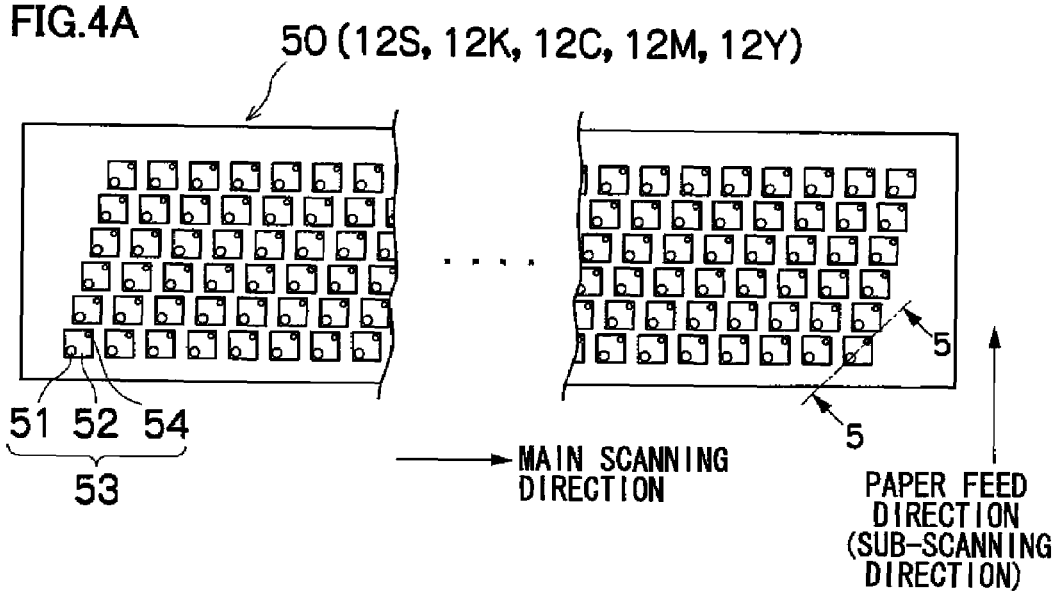
FIGS. 4A to 4C are plan view perspective diagrams showing examples of the composition of the head.
Figure 4B:
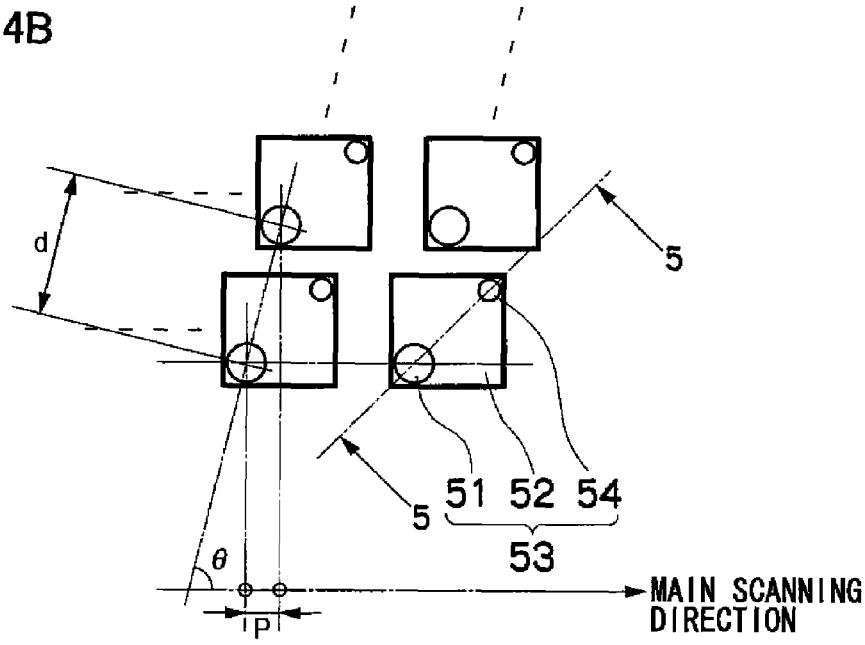
Figure 4C:
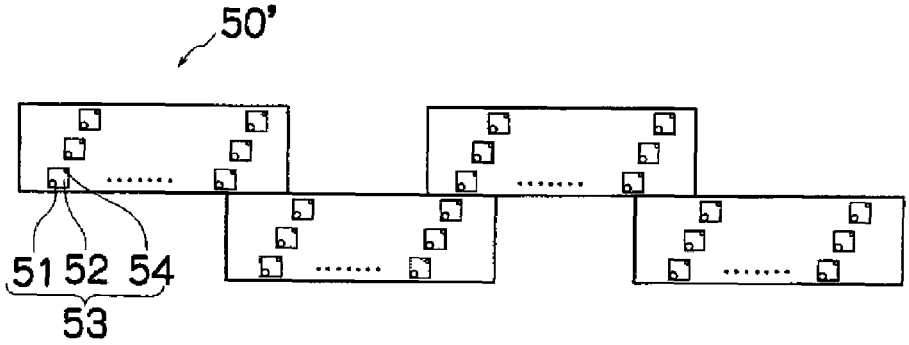
Figure 5:
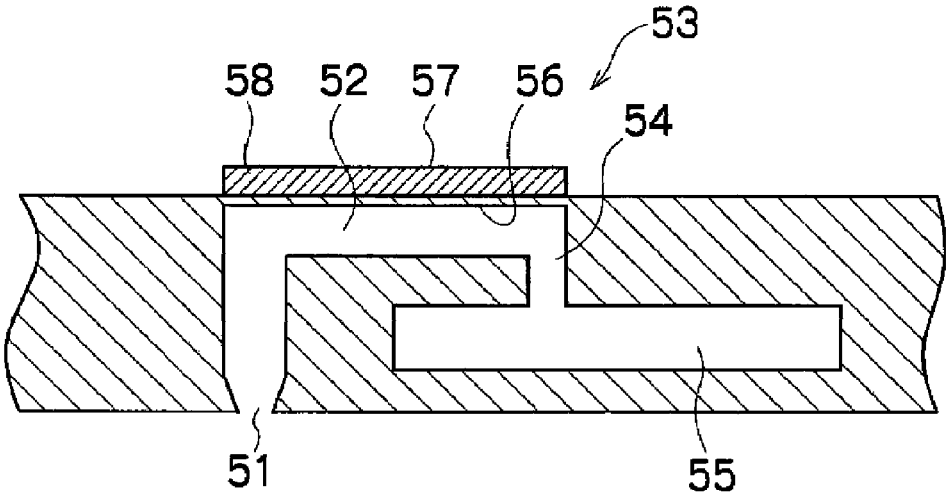
FIG. 5 is a cross-sectional view along line 5-5 in FIGS. 4A and 4B.

FIG. 4A is a plan view perspective diagram showing an example of the structure of a head 50, and FIG. 4B is an enlarged diagram of a portion of same. Furthermore, FIG. 4C is a plan view perspective diagram showing a further example of the composition of a print head 50, and FIG. 5 is a cross-sectional diagram showing a three-dimensional composition of an ink chamber unit (being a cross-sectional view along line 5-5 in FIGS. 4A and 4B). In order to achieve a high resolution of dots printed on the surface of the recording medium, it is necessary to achieve a high density of the nozzles in the print head 50. As shown in FIGS. 4A to 5, the print head 50 in the present embodiment has a structure in which a plurality of ink chamber units 53 including nozzles 51 for ejecting ink droplets and pressure chambers 52 connecting to the nozzles 51 are disposed in the form of a staggered matrix, and the effective nozzle pitch is thereby made small (the nozzle density is made high).

More specifically, as shown in FIGS. 4A and 4B, the print head 50 according to the present embodiment is a full-line head having one or more nozzle rows in which the plurality of nozzles 51 for ejecting ink are arranged through a length corresponding to the entire width (printable width) of the recording medium 16 in a direction substantially perpendicular to the paper feed direction.

Moreover, as shown in FIG. 4C, it is also possible to use heads 50' of nozzles arranged to a short length in a two-dimensional fashion, and to combine same in a zigzag arrangement, whereby a length corresponding to the full width of the recording medium is achieved.

Since it is sufficient that the treatment liquid is applied to the recording medium 16 in a substantially uniform (even) fashion in the region where ink droplets are to be ejected, then it is not necessary to form dots of the treatment liquid to a high density, in comparison with the ink. Consequently, it is possible that the treatment liquid ejection head 12S is composed with a reduced number of nozzles (a reduced nozzle density) in comparison with the print heads 50 (12K, 12C, 12M and 12Y) for ejecting ink. Furthermore, a composition may also be adopted in which the nozzle diameter of the treatment liquid ejection head 12S is greater than the nozzle diameter of the print heads 50 for ejecting ink.

As shown in FIG. 5, the pressure chamber 52 provided correspondingly to each of the nozzles 51 is approximately square-shaped in plan view, and the nozzle 51 and a supply port 54 are provided respectively at corners on a diagonal of the pressure chamber 52. Each pressure chamber 52 is connected through the supply port 54 to a common flow channel 55.

A piezoelectric element 58 provided with an individual electrode 57 is bonded to a pressure plate (diaphragm) 56, which forms the upper faces of the pressure chambers 52. When a drive voltage is applied between the individual electrode 57 and a common electrode, as which the pressure plate 56 also serves, the piezoelectric element 58 deforms, thereby changing the volume of the pressure chamber 52. This causes a pressure change which results in ink being ejected from the nozzle 51. When ink is ejected, new ink is supplied to the pressure chamber 52 from the common flow channel 55 through the supply port 54. The structure of the ink chamber unit 53 shown in FIG. 5 is merely one example, and it is of course also possible to use another structure.

As shown in FIGS. 4A and 4B, the plurality of ink chamber units 53 having this structure are arranged in a lattice arrangement, based on a fixed arrangement pattern aligned in a main scanning direction, which is the lengthwise direction of the print head 50, and an oblique direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles when projected to an alignment in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle of high density, in which the nozzle columns projected to align in the main scanning direction reach a total of 2,400 per inch (2,400 nozzles per inch, 2400 dpi). Below, in order to facilitate the description, it is supposed that the nozzles 51 are arranged in a linear fashion at a uniform pitch (P), in the main scanning direction. Here, the main scanning direction shown in FIGS. 4A and 4B is substantially parallel to the sensor scanning direction shown in FIG. 3, and the sub-scanning direction shown in FIG. 4A is substantially parallel to the paper feed direction shown in FIG. 3.

In implementing the present invention, the arrangement of the nozzles is not limited to that of the embodiment illustrated. Moreover, the piezo jet method is employed in the present embodiment where an ink droplet is ejected by means of the deformation of the piezoelectric element 58; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink being ejected by means of the pressure applied by these bubbles.

Description of Ink Supply System and Treatment Liquid Supply System

Next, the treatment liquid supply system and the ink supply system of the inkjet recording apparatus 10 are described. In the present embodiment, the treatment liquid supply system and the ink supply system have the same basic composition, and are described with respect to the ink supply system shown in FIG. 6. Below, the treatment liquid supply system and the ink supply system may be referred to jointly as the <"supply system".

Figure 6:
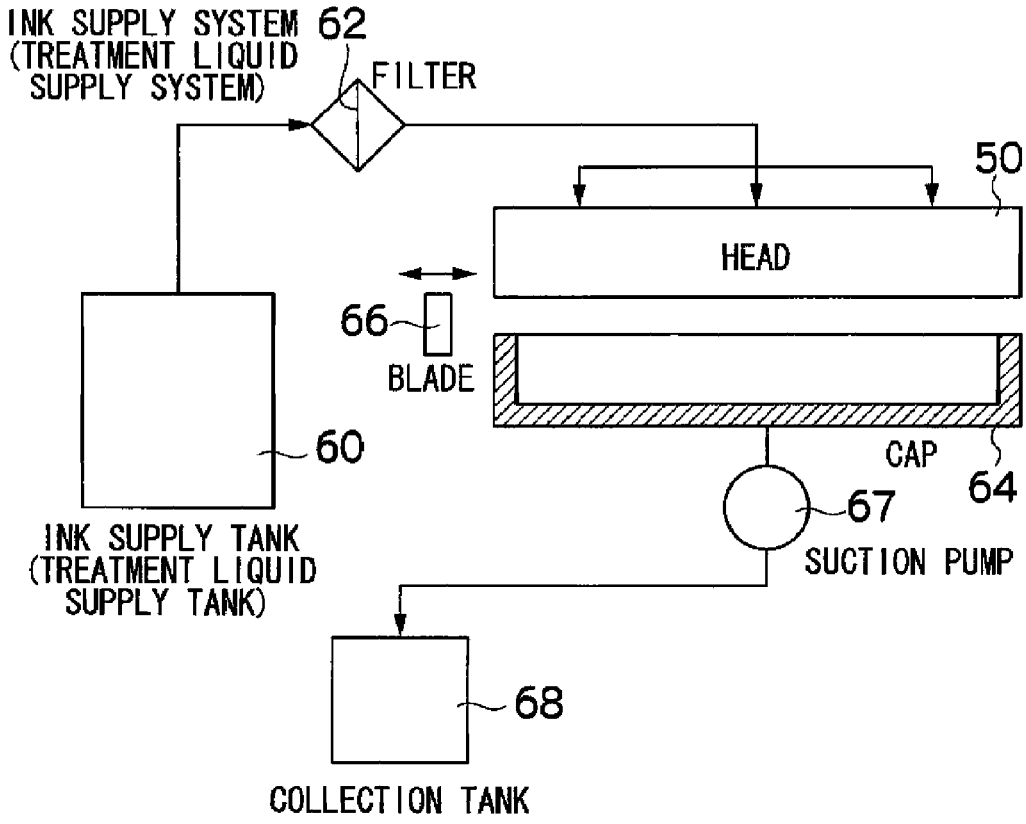
FIG. 6 is a principal block diagram showing the configuration of the supply system of the inkjet recording apparatus shown in FIG. 1.

FIG. 6 shows the composition of an ink supply system provided in the inkjet recording apparatus 10. The ink supply system shown in FIG. 6 corresponds to the storing and loading unit 14 shown in FIG. 1.

An ink supply tank (treatment liquid supply tank) 60 forming a base tank for supplying ink (treatment liquid) is disposed in the ink supply system shown in FIG. 6. The ink supply tank 60 may adopt a system for replenishing ink by means of a replenishing opening (not shown), or a cartridge system wherein cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

Furthermore, the ink in the ink supply tank 60 is supplied to the head 50 through prescribed tubing channels (not shown) and a filter 62, in order to remove foreign matter and air bubbles. The filter mesh size in the filter 62 is preferably equivalent to or less than the diameter of the nozzle and is commonly about 20 μm.

Although not shown in FIG. 6, it is preferable to provide a sub-tank integrally to the head 50 or nearby the head 50. The sub-tank has a damper function for preventing variation in the internal pressure of the head 50 and a function for improving refilling of the print head.

The inkjet recording apparatus 10 is also provided with a cap 64 as a device to prevent the nozzles 51 from drying out or to prevent an increase in the ink and treatment liquid viscosity in the vicinity of the nozzles 51, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is moved up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if it continues in a state of not ejecting ink or treatment liquid for a prescribed time period or more, then the solvent of the ink or treatment liquid in the vicinity of the nozzle evaporates and the viscosity of the ink or treatment liquid increase. In a situation of this kind, it will become impossible to eject ink or treatment liquid from the nozzle 51, even if the piezoelectric element 58 is operated. Therefore, before a situation of this kind develops (while the ink or treatment liquid is within a range of viscosity which allows it to be ejected by operation of the piezoelectric element 58), the piezoelectric element 58 is operated, and a preliminary ejection ("purge", "blank ejection", "liquid ejection" or "dummy ejection") is carried out toward the cap (ink receptacle), in order to expel the degraded ink or treatment liquid (namely, the ink or treatment liquid in the vicinity of the nozzle which has increased in viscosity).

Furthermore, if air bubbles enter into the ink or treatment liquid inside the head 50 (inside the pressure chamber 52), then even if the piezoelectric element 58 is operated, it will not be possible to eject the ink or treatment liquid from the nozzle. In a case of this kind, the cap 64 is placed on the head 50, the ink or treatment liquid (the ink or treatment liquid containing air bubbles) inside the pressure chamber 52 is removed by suction, by means of a suction pump 67, and the ink or treatment liquid removed by suction is then sent to a collection tank 68.

This suction operation is also carried out in order to remove degraded ink or treatment liquid having increased viscosity (hardened ink or treatment liquid), when ink or treatment liquid is loaded into the head for the first time, and when the head starts to be used after having been out of use for a long period of time. Since the suction operation is carried out with respect to all of the ink or treatment liquid inside the pressure chambers 52, the ink or treatment liquid consumption is considerably large. Therefore, desirably, preliminary ejection is carried out when the increase in the viscosity of the ink or treatment liquid is still minor.

The cleaning blade 66 is composed of rubber or another elastic member, and can slide on the ink ejection surface (surface of the nozzle plate) of the head 50 by means of a blade movement mechanism (wiper) (not shown). When ink droplets or foreign matter has adhered to the nozzle plate, the surface of the nozzle plate is wiped and cleaned by sliding the cleaning blade 66 on the nozzle plate. When the soiling on the ink ejection surface is cleaned away by the blade mechanism, a preliminary ejection is also carried out in order to prevent the foreign matter from becoming mixed inside the nozzle 51 by the blade.

Description of Control System

Figure 7:
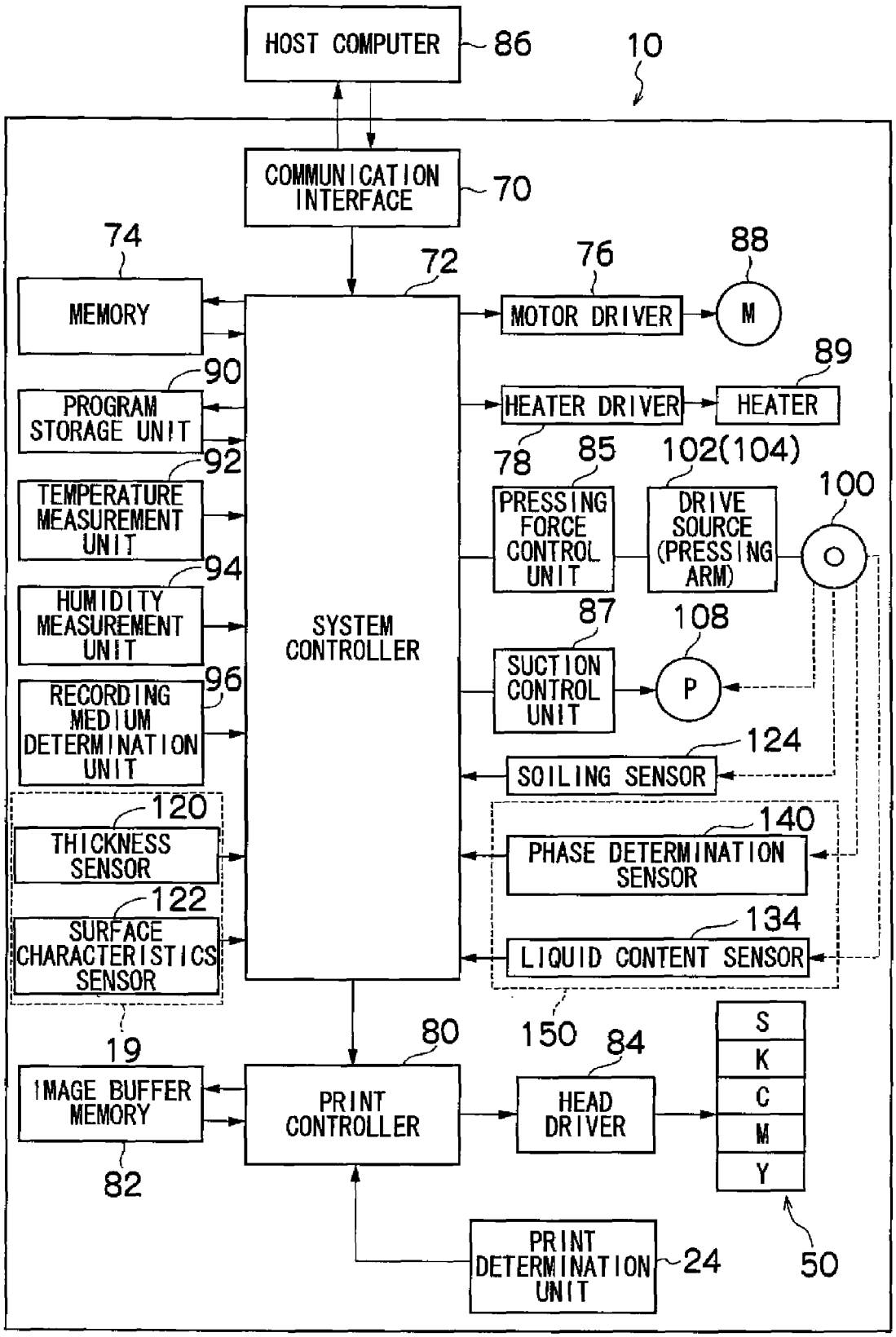
FIG. 7 is a principal block diagram showing the system configuration of the inkjet recording apparatus shown in FIG. 1.

FIG. 7 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, a pressing control unit 85, a suction control unit 87, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images input through the communication interface 70, and data is written and read to and from the image memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, pressing control unit 85, and the like, as well as controlling communications with the host computer 86 and writing and reading to and from the memory 74, and it also generates control signals for controlling the motor 88 and heater 89 of the conveyance system.

The motor driver 76 drives the motor 88 in accordance with commands from the system controller 72. The heater driver 78 drives the heater 89 of the heating fan 40 or the like in accordance with commands from the system controller 72.

FIG. 7 shows only one motor 88, but in practice, a plurality of motors (actuators) are provided, such as a drive motor for the suction belt conveyance unit 22, the motors of the rotational mechanism and movement mechanism of the absorbing roller 100, and the like. Furthermore, a plurality of motor drivers 76 are provided for controlling the plurality of motors 88. Of course, it is also possible to integrate all or a portion of the plurality of motor drivers.

The print controller 80 has a signal processing function for performing various tasks, compensations, and other types of processing for generating print control signals from the image data stored in the memory 74 in accordance with commands from the system controller 72 so as to supply the generated print data to the head driver 84. Prescribed signal processing is carried out in the print controller 80, and the ejection amount and the ejection timing of the ink droplets and treatment liquid from the respective print heads 50 are controlled through the head driver 84.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 generates a drive signal on the basis of print data supplied by the print controller 80, and drives the piezoelectric elements of the heads 12S, 12K, 12C, 12M and 12Y, on the basis of this drive signal. A feedback control system for maintaining constant drive conditions in the head may be included in the head driver 84.

The pressing control unit 85 generates a drive signal (pulse signal) on the basis of a command signal supplied by the system controller 72, and drives the drive source 102 of the pressing arm 104 by means of this drive signal. More specifically, a positional control type of motor, such as a stepping motor, servo motor, or the like, is used for the drive source 102, and the amount of movement of the pressing arm 104 is governed by means of the number of pulses of the pulse signal (the movement amount information in the drive signal).

The image data to be printed is externally (for example, from the host computer 86) input through the communication interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the input ROB image data into dot data for four colors, K, C, M and Y. The dot data generated by the print controller 80 is stored in the image buffer memory 82.

In the present embodiment, the memory 74 is shown as a storage unit attached to the system controller 72, but the memory 74 may also be constituted by a plurality of memories (storage media). Furthermore, it is also possible to incorporate the memory 74 into the system controller 72. The information stored in the memory 74 may include, in addition to the RGB image data described above, various setting information, system parameters, a threshold value table used to judge conditions, various types of data tables, corrective coefficients used for various corrections, and the like.

The suction control unit 87 controls the on and off switching of the suction device 108, and the rotational speed and rotational frequency of the suction device 108, on the basis of a control signal output from the system controller 72. By controlling the driving force of the suction device 108, through the suction control unit 87, it is possible to vary the absorption force (liquid removal capability) of the absorbing roller 100 shown in FIG. 3.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided.

The program storage unit 90 may also be combined with a storage device (memory) (not shown) for storing operational parameters (system parameters), and the like.

The print determination unit 24 is a block that includes the line sensor as described above with reference to FIG. 1, reads the image printed on the recording medium 16, determines the ejection conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24.

The inkjet recording apparatus 10 comprises a temperature measurement unit 92 and a humidity measurement unit 94, which measure the ambient temperature and the ambient humidity of the head 50 and the recording medium 16 in the print region. A temperature signal (temperature information) which indicates the temperature measured by the temperature measurement unit 92, and a humidity signal (humidity information) indicating the humidity measured by the humidity measurement unit 94 are sent to the system controller 72. The system controller 72 controls a temperature modification device, such as the heater 89, cooling fan (not shown), or the like, in such a manner that a prescribed (settled) temperature and humidity are maintained on the basis of the temperature signal and the humidity signal.

Furthermore, the present inkjet recording apparatus 10 comprises a recording medium determination unit 96 which determines the type of recording medium used, and implements various types of control, such as control of the distance between the absorbing roller 100 and the recording medium 16, the suction force of the suction device 108, and the ejection of treatment liquid and ink, control of the temperature and humidity in the head 50, and the like, in accordance with the type of recording medium determined by the recording medium determination unit 96. In other words, a composition is adopted wherein, when the recording medium type information obtained by the recording medium determination unit 96 is sent to the system controller 72, the system controller 72 controls the respective units on the basis of this recording medium type information.

The mode of determining the type of recording medium by means of the recording medium determination unit 96 may involve an operator inputting the prescribed recording medium type through a man-machine interface, such as a keyboard, touch panel, or the like, or the type of paper used may be determined automatically by reading in information from an information recording body, such as a barcode or wireless tag, in which paper type information is recorded, this information recording body being attached to the magazine or tray of the recording medium 16.

On the other hand, the type of recording medium 16 to be used may be determined directly by means of the recording medium determination unit 19, and the recording medium type may be judged on the basis of these determination results. The system controller 72 can obtain the thickness information and the surface properties information of the recording medium 16 through the thickness sensor 120 and the surface properties sensor 122 contained in the recording medium determination unit 19. In the system controller 72, the distance between the absorbing roller 100 and the recording medium 16 (the pressure exerted by the absorbing roller 100) shown in FIG. 3, and the suction force of the suction device 108, and the like, are controlled on the basis of the thickness information and surface properties information of the recording medium 16.

For example, when a recording medium having a rough surface, such as a coated paper, recycled paper, or the like, is used for the recording medium 16, then the ink coloring material is less liable to become attached to the recording medium, and it is necessary to weaken the force with which the absorbing roller 100 is pressed against the recording medium 16, or the suction force of suction device 108, in such a manner that the coloring material is not transferred to the surface of the absorbing roller 100. On the other hand, in the case of a smooth recording medium having good surface properties, such as an OHP sheet the coloring material is less liable to be removed from the surface of the recording medium, and the ink coloring material is less liable to become attached to the absorbing roller 100. Therefore, the pressing force of the absorbing roller 100 against the recording medium 16 or the suction force of the suction device 108 is increased, thereby raising the efficiency of the liquid removal operation.

The surface state information of the absorbing roller 100 obtained by the soiling sensor 124 is sent to the system controller 72. In the system controller 72, the surface state information of the absorbing roller 100 obtained beforehand through the soiling sensor 124 is stored in a storage medium such as the memory 74, the difference between the surface state information of the absorbing roller 100 stored in the storage medium and the surface state information of the absorbing roller 100 obtained from the soiling sensor 124 is determined, and the pressing force of the absorbing roller 100 against the recording medium 16 or the suction force of the suction device 108 is controlled in accordance with the result of the comparison between this difference and a beforehand settled threshold value. By using a method of this kind, the effect of the adhering matter which is originally attached to the absorbing roller 100 is cancelled out (this is equivalent to calibrating the absorbing roller 100). Furthermore, the surface state information of the absorbing roller 100 is stored at regular intervals, and by successively adding up (integrating) this information, it is possible to calculate the speed at which the surface state of the absorbing roller 100 changes (the speed of progress of the soiling), and hence the replacement time for the absorbing roller 100 may be estimated on the basis of this speed of progress of the soiling. Moreover, it is also possible to adopt a composition in which the replacement time of the absorbing roller 100 estimated in this way is reported to the user.

On the other hand, information relating to the amount of liquid contained in the absorbing roller 100 (liquid volume information), as obtained by the liquid volume measurement unit 150 including the liquid content sensor 134 and a liquid content meter 136, is supplied to the system controller 72. In the system controller 72, the liquid volume information obtained from the liquid volume measurement unit 150 is compared with a beforehand settled threshold value, and it is determined whether or not the liquid volume removed from the recording medium 16 is a suitable volume, on the basis of this comparison result. Furthermore, by successively adding up the liquid volume value measured by the liquid volume measurement unit 150, the timing of maintenance for the absorbing roller 100 (liquid removal processing) can be determined.

Description of Liquid Removal Control

There follows a description of a liquid removal capability setting and control procedure, which sets the liquid removal capability of the absorbing roller 100 (namely, the pressing force against the recording medium 16 and the suction force of the suction device 108), in the liquid removal control implemented in the inkjet recording apparatus 10. The inkjet recording apparatus 10 is composed in such a manner that solvent remaining on the recording medium 16 is removed, thereby preventing rear-side transfer or image deterioration occurring when the print surface of the recording medium 16 makes contact with another recording medium 16 after printing, as well as preventing cockling of the recording medium 16. In the liquid removal control performed in the inkjet recording apparatus 10, the liquid removal capability of the absorbing roller 100 is set (adjusted) in accordance with the type of recording medium 16, and hence desirable liquid removal is performed in accordance with the various conditions of the recording medium 16. The present embodiment exemplifies a mode where the liquid removal capability of the absorbing roller 100 is controlled by altering the suction force of the suction device 108.

Figure 8:
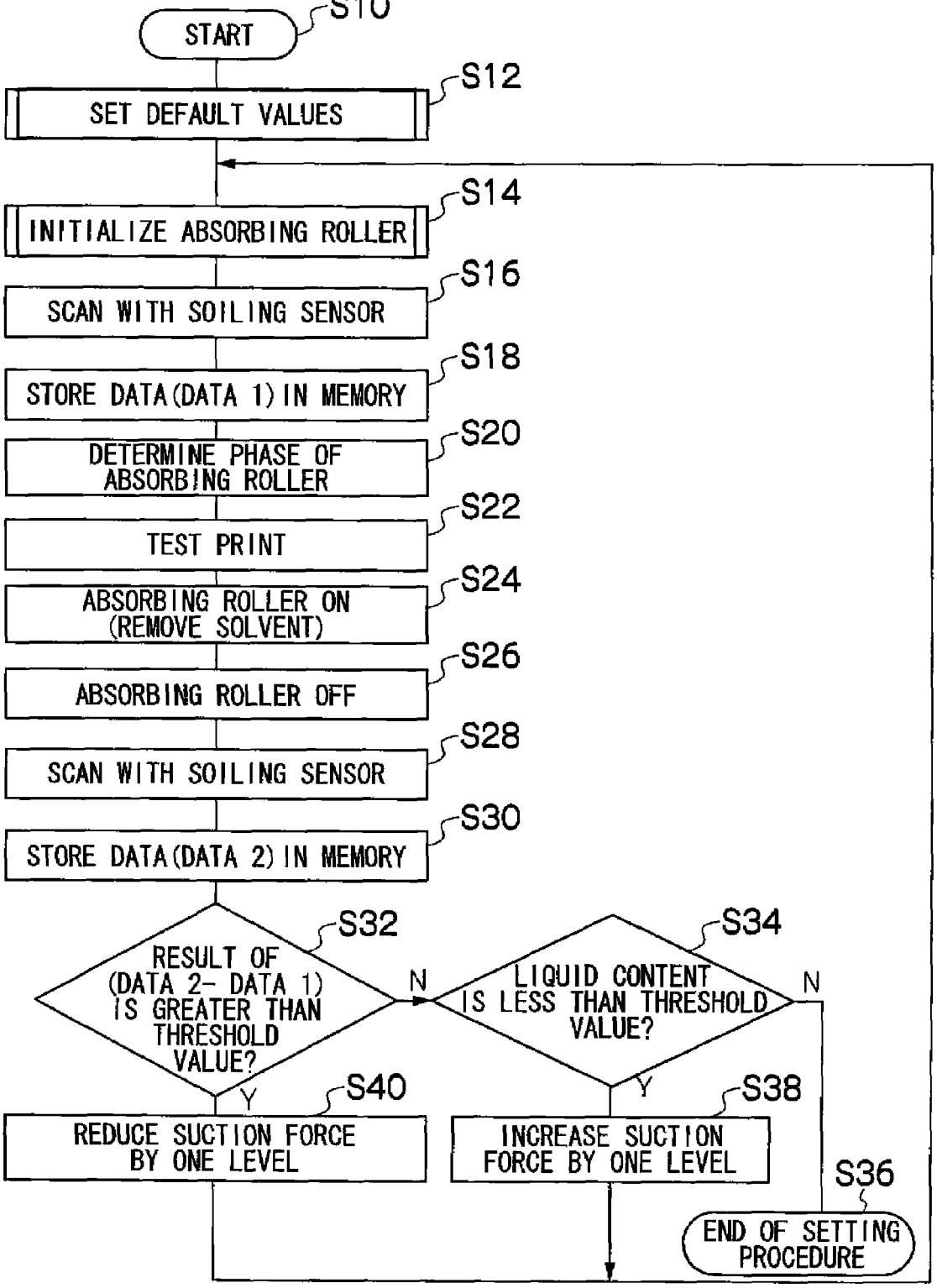
FIG. 8 is a flowchart showing a liquid removal capability setting control procedure according to the first embodiment of the present invention.
Figure 9:
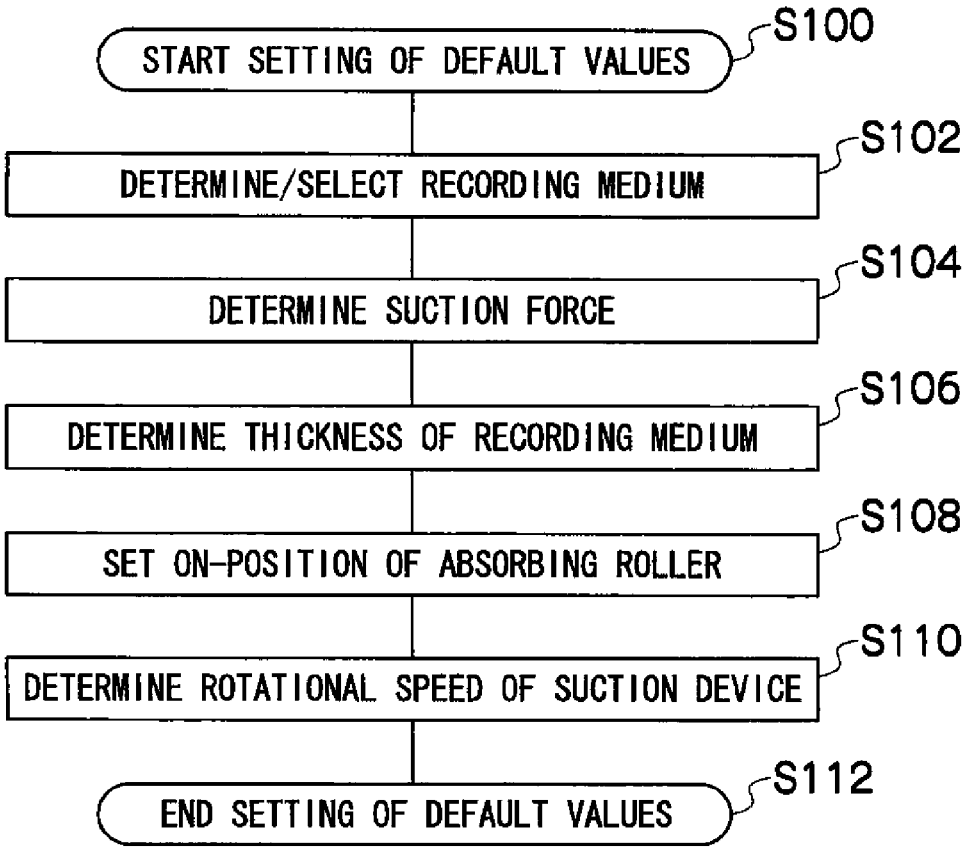
FIG. 9 is a flowchart showing a default value setting sequence of the liquid removal capability setting control procedure shown in FIG. 8.
Figure 10:
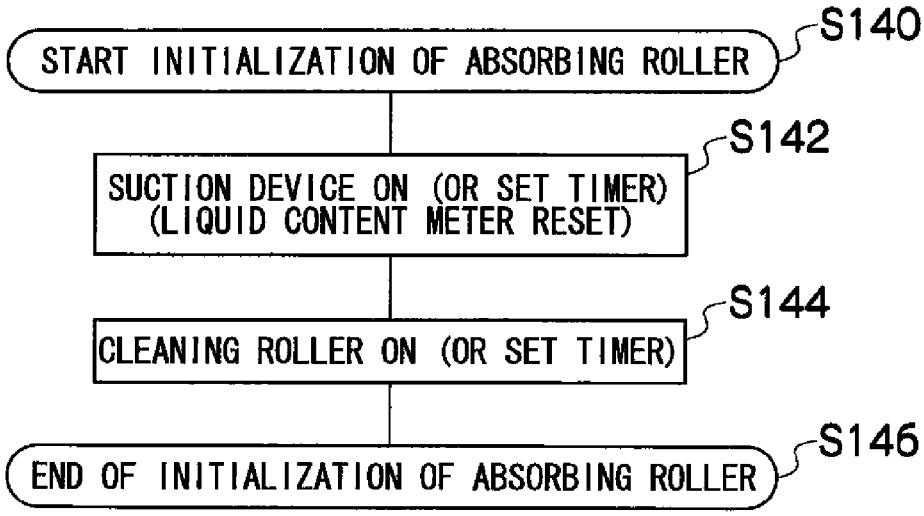
FIG. 10 is a flowchart showing an absorbing roller initialization sequence of the liquid removal capability setting control procedure shown in FIG. 8.

FIGS. 8 to 10 are flowcharts showing the sequence of liquid removal capability setting control according to the present embodiment. FIG. 8 is a flowchart of the main control sequence, and FIGS. 9 and 10 relate to FIG. 8 and are flowcharts of a default value setting subroutine, and an absorbing roller initialization sub-routine, respectively.

As shown in FIG. 8, when the liquid removal capability setting control is started (step S10), default value setting is carried out in order to set default values for the position of the absorbing roller 100 in the thickness direction of the recording medium 16 during liquid removal, and the suction force of the suction device 108 (step S12). FIG. 9 shows the details of the default value setting process in step S12 in FIG. 8.

As shown in FIG. 9, when the default value setting process is started (step S100), the recording medium is determined or selected (preset) (step S102). In the case of a preset in step S102, it is possible to determine the type of recording medium 16 by means of the recording medium determination unit 96 shown in FIG. 7, and the thickness and surface properties of the recording medium 16 can be determined by using the recording medium determination unit 19.

In step S104 shown in FIG. 9, the default value of the suction force of the suction device 108 is settled in accordance with the type of recording medium 16 preset at step S102. A composition may be adopted in which the relationship between the types of recording media 16 and the default values of the suction force of the suction device 108 is stored beforehand in a data table, and the default value of the suction force of the suction device 108 is determined by referring to the data table on the basis of the type of recording medium 16 preset at step S102.

Next, when the thickness information of the recording medium 16 is acquired (or when the thickness of the recording medium is determined) (step S106), the default position of the absorbing roller 100 during liquid removal (during the roller is being switched on) is settled on the basis of the thickness information of the recording medium 16 (step S108), and the default value of the speed of rotation of the suction device 108 during solvent removal is also determined (step S110), thereby completing the default value setting process (step S112). More specifically, in the default value setting shown in FIG. 9, various conditions in the liquid removal unit 25 are determined, such as the default position of the absorbing roller 100 during liquid removal, and the default value of the rotational speed of the suction device 108, and the like.

When the default value setting in step S12 in FIG. 8 has terminated, an initialization process of the absorbing roller 100 is carried out (step S14). FIG. 10 shows the details of the initialization process for the absorbing roller 100 in step S14 in FIG. 8.

As shown in FIG. 10, when the initialization of the absorbing roller 100 is started (step S140), the start of operation of the suction device 108 is set (or a timer indicating an operational start timing of the suction device 108 is set), and the suction device 108 is operated at high speed, thereby removing the liquid content on the surface of the absorbing roller 100 and the liquid content inside the absorbing roller 100. At the same time, the liquid content meter 136 is reset (step S142). As a method for removing the liquid contained inside the absorbing roller 100, it is also possible to adopt a method which dries the absorbing roller 100 by blowing heated air onto the absorbing roller 100, for example.

Thereupon, the absorbing roller 100 is cleaned by means of a cleaning roller 112 (step S144), and the initialization of the absorbing roller 100 in step S14 in FIG. 8 then terminates (step S146). It is possible to adopt a composition in which a timer indicating the timing to implement the cleaning of the absorbing roller 100 is set in step S144 in FIG. 10. The cleaning of the absorbing roller 100 may be based on a dry cleaning method (a method in which heated air is blown onto the absorbing roller 100, thus drying the absorbing roller 100 and causing the foreign matter adhering to the surface of the roller to peel away), or on a wet cleaning method (a method in which a cleaning liquid is blown onto the absorbing roller 100, thus removing the soiling).

When the initialization of the absorbing roller 100 shown in FIG. 10 is concluded, then the surface state of the absorbing roller 100 is determined by scanning with the soiling sensor 124 (step S16 in FIG. 8), and the determination results are stored as "data 1" (step S18). The data 1 acquired at step S18 indicates the initial surface state of the absorbing roller 100 (the soiling information of the initial state).

Thereupon, the absorbing roller 100 is aligned in phase (step S20) in such a manner that the liquid removal on the recording medium 16 is carried out at the position where the liquid content sensor 134 is installed and a test print is then carried out (step S22). In the test print carried out at step S22, ink is ejected under conditions of the maximum ejection volume for the type of recording medium 16 preset at step S102 in FIG. 9.

When the test print implemented at step S22 has been carried out, the absorbing roller 100 is made to contact the liquid on the recording medium 16 (the absorbing roller 100 is switched on) and the liquid is removed from the recording medium 16 (step S24), and after a prescribed time period has elapsed, the liquid removal is ended by switching off the absorbing roller 100 in such a manner that the absorbing roller 100 and the recording medium 16 assume a non-contact state (step S26). The surface state of the absorbing roller 100 is then determined by scanning with the soiling sensor 124 (step S28), and the determination results are stored as "data 2" (step S30).

When the surface state information (data 2) relating to the absorbing roller 100 acquired in step S28 has been stored (step S30), the differential data relating to the surface state obtained by subtracting data 1 from data 2 is compared with a beforehand settled threshold value (step S32). The differential data of the surface state indicates the amount of change in the surface state of the absorbing roller 100 (and corresponds to the amount of the adhering matter that has become attached to the roller during liquid removal).

In step S32, when the differential data ((data 2)−(data 1)) is not greater than the beforehand settled threshold value (NO verdict), in other words, when foreign matter such as ink coloring material has not become attached to the surface of the absorbing roller 100 (or when foreign matter has become attached to the roller, but the amount thereof is extremely small and hence is not problematic), then the procedure advances to step S34.

In step S34, the liquid content of the absorbing roller 100 (the amount of liquid removed from the recording medium 16 by the absorbing roller 100 during liquid removal) is compared with a beforehand settled threshold value, and if the liquid content is not less than the threshold value (NO verdict), then this means that a prescribed amount of liquid has been removed from the absorbing roller 100, while at the same time, the ink coloring material has not been removed during liquid removal. Therefore, the suction force of the suction device 108 is judged to be suitable, and the suction force of the suction device 108 is set to the default value (or left at the default value), whereupon the liquid removal capability setting control procedure terminates (step S36).

On the other hand, if the liquid content of the absorbing roller 100 is less than the threshold value at step S34 (YES verdict), then it is judged that the suction force of the suction device 108 is insufficient (in other words, the prescribed amount of liquid cannot be removed at the current suction force setting), and the suction force of the suction device 108 is increased by one level (step S38), whereupon the procedure returns to step S14.

Furthermore, at step S32, if the differential data ((data 2)−(data 1)) is greater than the beforehand settled threshold value, in other words, if an intolerable level of foreign matter such as ink coloring material has become attached to the surface of the absorbing roller 100 (YES verdict), then the suction force of the suction device 108 is reduced by one level (step S40), and the procedure then returns to step S14.

In this way, the suction force setting that is suited to the type of the recording medium 16 is determined for the suction device 108 by repeating step S14 to step S40 shown in FIG. 8.

FIG. 8 shows the mode in which the liquid removal capability of the absorbing roller 100 is changed by altering the suction force of the suction device 108, but in a mode where the liquid removal capability of the absorbing roller 100 is changed by altering the pressing force of the absorbing roller 100, at step S38, the pressing arm 104 is operated so as to raise the pressing force of the absorbing roller 100 against the recording medium 16, by one level, instead of raising the suction force of the suction device 108 by one level, and at step S40, the pressing arm 104 is operated so as to reduce the pressing force of the absorbing roller 100 against the recording medium 16, by one level, instead of reducing the suction force of the suction device 108 by one level.

Liquid Removal Capability of Absorbing Roller

As described above, the method for changing the liquid removal capability of the absorbing roller 100 may be a method which changes the pressing force of the absorbing roller 100 against the recording medium 16 (the position of the absorbing roller 100 in the thickness direction), or a method which changes the suction force (rotational speed) of the suction device 108. Either one of these factors, or both of these factors may be changed. Furthermore, it is also possible to beforehand store liquid removal capability tables (absorption force tables) in accordance with the properties of the recording medium 16, and to change the liquid removal capability in accordance with the absorption force tables.

FIGS. 11 and 12 show embodiments of the absorption force tables. The absorption force table 200 shown in FIG. 11 corresponds to OHP sheets (resin film), and the absorption force table 202 shown in FIG. 12 corresponds to art paper.

When using an OHP sheet as the recording medium 16, the ink coloring material is not liable to adhere to the absorbing roller 100 during liquid removal, and the liquid removal capability of the absorbing roller 100 is mainly adjusted by changing the suction force (rotational speed) of the suction device 108. In other words, if the liquid removal capability is increased by one level (at (+1) in FIG. 11), then the position of the absorbing roller 100 is not changed and the rotational speed of suction device 108 is controlled to a value of 1.2 times the default value (at (0) in FIG. 11). Furthermore, if the liquid removal capability is increased by two levels (at (+2) in FIG. 11), then the absorbing roller 100 is moved in such a manner that the position of the absorbing roller 100 (clearance) is 0.8 times the default value (in other words, so that the absorbing roller 100 is positioned closer to the recording medium 16 than the default position), and furthermore, the rotational speed of the suction device 108 is controlled to be 1.4 times the default value.

On the other hand, if the liquid removal capability of the absorbing roller 100 is reduced by one level (at (−1) in FIG. 11), then the position of the absorbing roller 100 is not changed from the default position, while the rotational speed of the suction device 108 is set to 0.8 times the default value. If the liquid removal capability of the absorbing roller 100 is reduced by two levels (at (−2) in FIG. 11), then the absorbing roller 100 is moved in such a manner that the position of the absorbing roller 100 (clearance) is 1.2 times the default value (in other words, the absorbing roller 100 is distanced further from the recording medium 16 than the default position), and the rotational speed of the suction device 108 is controlled so as to be 0.6 times the default value.

When art paper is used for the recording medium 16, the ink coloring material is liable to become attached to the absorbing roller 100 during liquid removal, and hence the liquid removal capability is adjusted mainly by changing the position of the absorbing roller 100 in the thickness direction of the recording medium 16. In other words, if the liquid removal capability is increased by one level (at (+1) in FIG. 12), then the rotational speed of the suction device 108 is not changed from the default value (at (0) in FIG. 12) and the position of the absorbing roller 100 is controlled to a value of 0.9 times the default value.

Furthermore, if the liquid removal capability is increased by two levels (at (+2) in FIG. 12), then the rotational speed of the suction device 108 is set to 1.1 times the default value, and the absorbing roller 100 is moved in such a manner that the position of the absorbing roller 100 (clearance) becomes 0.8 times the default value.

On the other hand, if the liquid removal capability of the absorbing roller 100 is reduced by one level (at (−1) in FIG. 12), then the rotational speed of the suction device 108 is not changed from the default value ((0) in FIG. 12) and the position of the absorbing roller 100 is controlled to a value of 1.1 times the default value. Furthermore, if the liquid removal capability is reduced by two levels (at (−2) in FIG. 12), then the rotational speed of the suction device 108 is set to 0.9 times the default value, and the absorbing roller 100 is moved in such a manner that the position of the absorbing roller 100 (clearance) becomes 1.2 times the default value.

The absorption force tables such as shown in FIGS. 11 and 12 are stored beforehand for types of recording media 16, and the liquid removal capability of the absorbing roller 100 is adjusted by referring to the absorption force tables. Furthermore, desirably, a composition is adopted in which the adsorption force tables are updated in accordance with the temporal change of the absorbing roller 100.

Since there are types of ink having properties whereby the ink is liable to peel away from the recording medium 16 and other types of ink having properties whereby the ink is liable to adhere to the absorbing roller 100, then the liquid removal capability of the absorbing roller 100 may be changed in accordance with the type of ink.

Other Mode of Test Print

Figure 13:
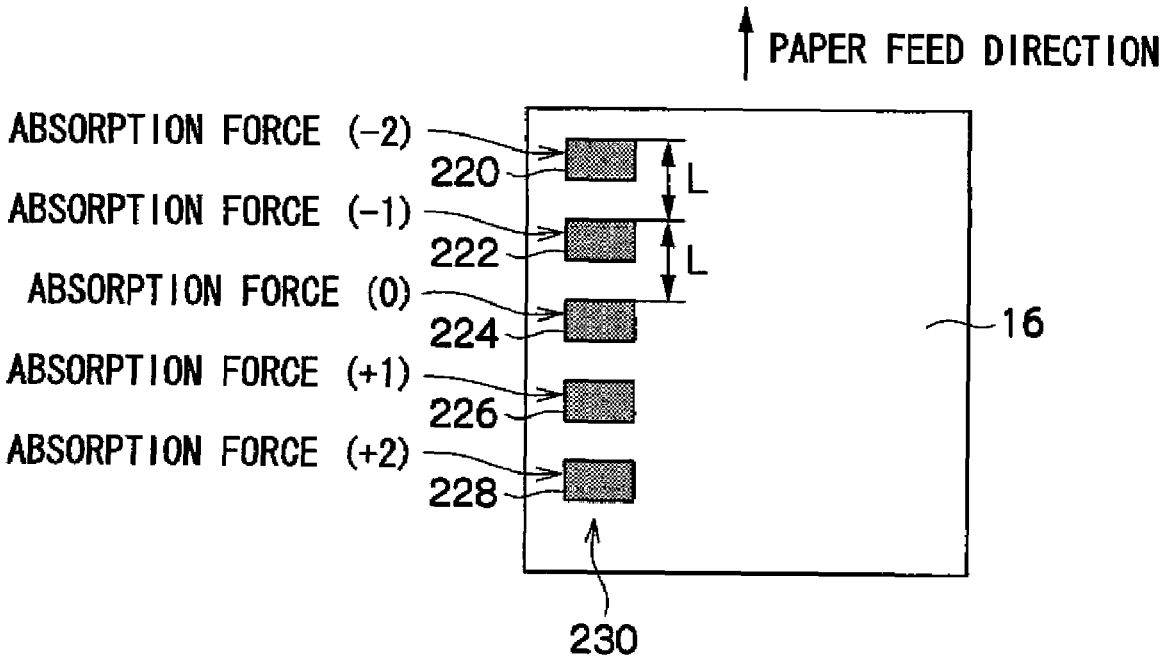
FIG. 13 is a diagram showing a test print.

In the liquid removal capability setting control shown by the flowchart in FIG. 8, the liquid removal capability that is suitable for the recording medium 16 in use is set by printing test patches while changing the liquid removal capability by one level for each patch. As shown in FIG. 13, it is also possible to set the optimum liquid removal capability by printing a continuous test patch and changing the liquid removal capability in a stepwise fashion. FIG. 13 shows a case where a test pattern 230 comprising five test patches 220 to 228 arranged in the paper feed direction is formed, and liquid removal is carried out by changing the liquid removal capability for the test patches, the surface state and liquid content of the absorbing roller 100 being determined accordingly, and the optimal liquid removal capability of the absorbing roller 100 being set on the basis of these determination results.

The test patches 220 to 228 shown in FIG. 13 are aligned at constant intervals at a pitch of L. By setting the arrangement pitch L of the test patches to be substantially the same as the circumference length of the absorbing roller 100, it is possible to remove liquid with the liquid content sensor 134 always being located in a certain position. Furthermore, the liquid removal capability of the absorbing roller 100 is settled with reference to the absorption force table 200 (or 202) shown in FIG. 11 (or FIG. 12).

In the embodiment shown in FIG. 13, the liquid removal capability in the liquid removal of the test patch 220 is set to the 2-level-down (−2) liquid removal capability shown in FIG. 11, and the liquid removal capability in the liquid removal of the test patch 222 is set to the 1-level-down (−1) liquid removal capability shown in FIG. 11. Furthermore, the liquid removal capability in the liquid removal of the test patch 224 is set to the default value (0) liquid removal capability, and the liquid removal capability in the liquid removal of test patches 226 and 228 is set respectively to the 1-level-up (+1) and 2-level-up (+2) liquid removal capabilities shown in FIG. 11. In other words, the liquid removal capabilities in the liquid removal of test patches 220 to 228 are changed, one level at a time, from the 2-level-down liquid removal capability in FIG. 11, to the 2-level-up liquid removal capability. When forming the test patches, ink is ejected under conditions of the maximum ejection volume.

In the inkjet recording apparatus 10 having the composition shown above, the liquid removal capability of the absorbing roller 100 during liquid removal is set in accordance with the thickness and surface characteristics of the recording medium 16, and the like. More specifically, a test pattern is printed on the recording medium 16, liquid removal is carried out with respect to the test pattern, the adhering matter, such as ink coloring material, which adheres to the absorbing roller 100 after the completion of liquid removal, and the liquid volume contained in the absorbing roller 100, are determined, and the liquid removal capability of the absorbing roller 100 is adjusted on the basis of these determination results. Consequently, suitable liquid removal corresponding to the type of recording medium 16 is implemented, and cockling caused by an insufficient liquid removal capability, or peeling away of the ink coloring material due to an excessive liquid removal capability, or the like, is prevented. Therefore, a desirable image is formed on the recording medium 16.

In the aforementioned embodiments, the two-liquid system is used in which the ink coloring material is fixed onto the recording medium by making the treatment liquid react with the ink on the recording medium 16, but the present invention may also be applied to a mode in which the ink is fixed onto the surface or interior of the recording medium 16 without using treatment liquid.

Furthermore, when the temperature or humidity varies, then the viscosity, surface tension, and the like, of the ink and treatment liquid may change and the surface state, thickness, and the like, of the recording medium 16 may also change. Therefore, correctional coefficients are beforehand set for the pressing force of the absorbing roller 100 or the suction force of the suction device 108, in accordance with the temperature and humidity (in other words, a correction table for temperature and humidity is stored), and the liquid removal capability of the absorbing roller 100 is also controlled on the basis of the measurement results of the temperature measurement unit 92 and the humidity measurement unit 94.

Second Embodiment

Next an inkjet recording apparatus 300 according to a second embodiment of the present invention is described. In the inkjet recording apparatus 300, the recording medium 16 is observed, and the liquid removal capability of the absorbing roller 100 during liquid removal is controlled on the basis of the result of the observing operation. The present embodiment exemplifies a mode where the liquid removal capability of the absorbing roller 100 is controlled by altering the suction force of the suction device 108.

Figure 14:
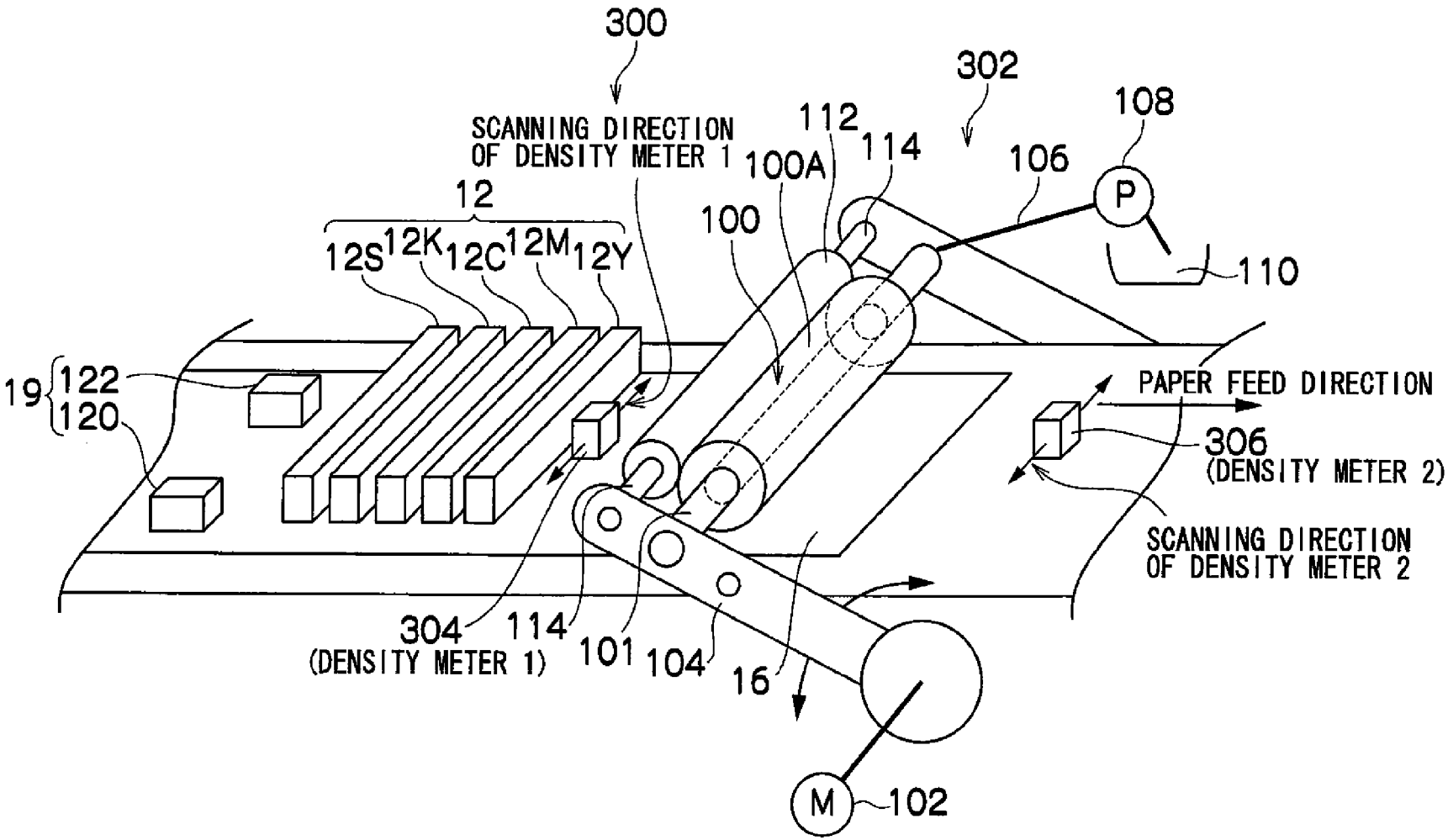
FIG. 14 is a principal schematic drawing showing a liquid removal unit in an inkjet recording apparatus according to a second embodiment of the present invention.
Figure 15:
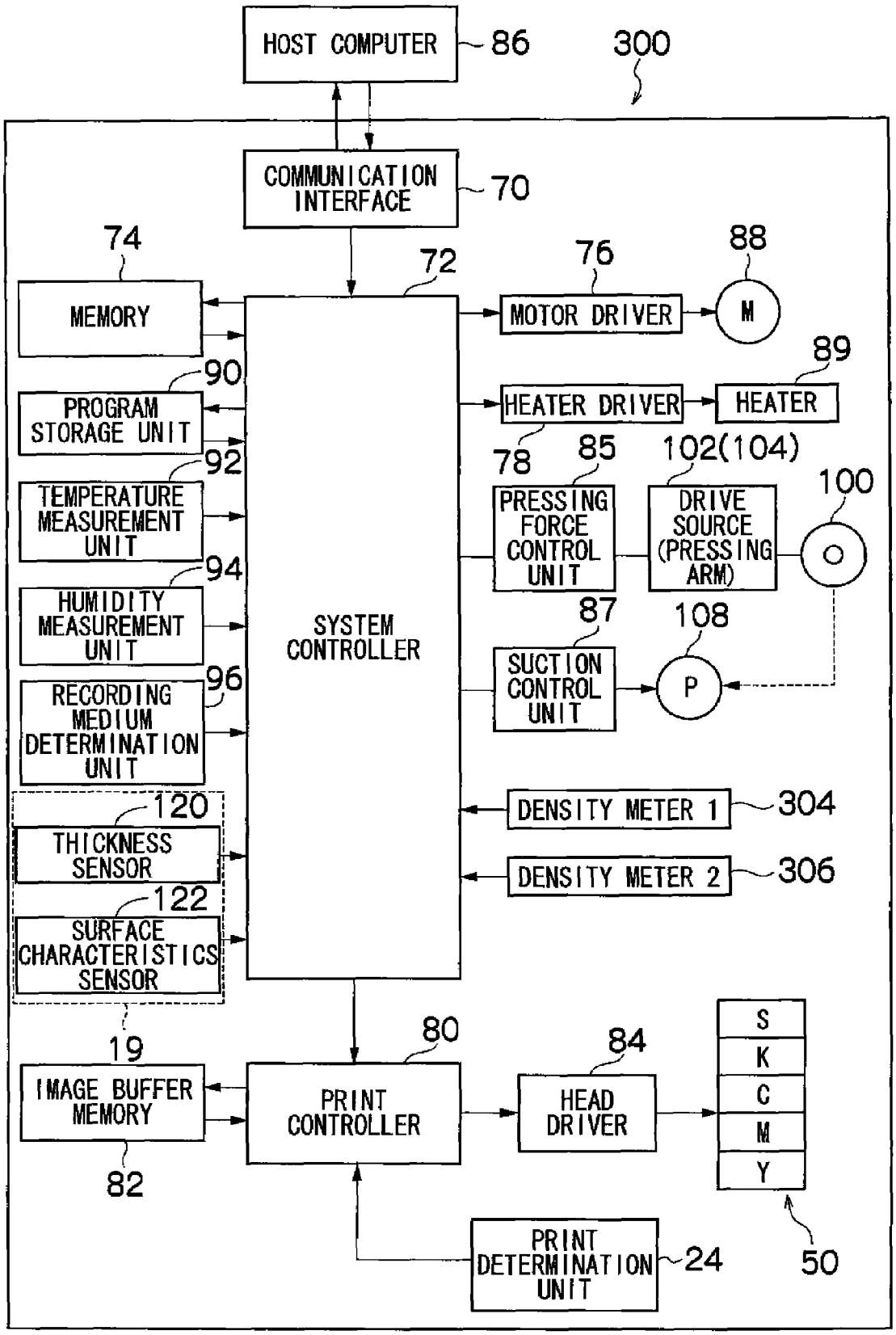
FIG. 15 is a principal block diagram showing the system configuration of the inkjet recording apparatus shown in FIG. 14.

FIG. 14 is a principal schematic drawing showing the composition of the liquid removal unit 302 of the inkjet recording apparatus 300, and FIG. 15 is a principal block diagram showing the system composition of the inkjet recording apparatus 300. The overall composition of the inkjet recording apparatus 300 is similar to that of the inkjet recording apparatus 10 shown in FIG. 1, and here, a general description is omitted and those parts which are different to the inkjet recording apparatus 10 shown in FIG. 1 are described. Furthermore, parts in FIG. 14 which are the same as or similar to those in FIG. 3, and parts in FIG. 15 which are the same as or similar to those in FIG. 7 are denoted with the same reference numerals and description thereof is omitted.

The liquid removal unit 302 of the inkjet recording apparatus 300 shown in FIG. 14 is provided with a density meter 304 (density meter 1) on the upstream side of the absorbing roller 100 in terms of the paper feed direction, and a density meter 306 (density meter 2) on the downstream side of the absorbing roller 100 in terms of the paper feed direction. The density of the ink coloring material in the image (dots forming the image) formed on the recording medium 16 is measured with the density meter 1 and the density meter 2, and the measurement results are fed back into the procedure for setting the liquid removal capability of the absorbing roller 100. More specifically, as shown in FIG. 15, the system controller 72 obtains information on the density of the ink coloring material before liquid removal, as measured through the density meter 1, and information on the density of the ink coloring material after liquid removal, as measured through the density meter 2. The system controller 72 finds the density difference from the obtained information, and if the density difference is greater than a prescribed threshold value, then it is determined that ink coloring material has been removed, together with the liquid, during the liquid removal process, and control is implemented in order to reduce the suction force of the suction device 108.

Each of the density meters 1 and 2 used in the present embodiment includes a light emitting section and a light receiving section. The light irradiated from the light emitting section onto the recording medium 16 and reflected by the ink coloring material (reflected light component) is received by the light receiving unit, and the density of the ink coloring material is found from the strength of the color of the ink coloring material (color intensity), on the basis of the amount of reflective light measured by the light receiving unit (the strength of the reflected light). The density of the ink coloring material measured by the density meter 1 needs to be corrected in respect the reflected light component created by the ink solvent (mainly water). In other words, in the density meter 1, a corrected light amount is determined by correcting the amount of light measured by the light receiving unit in respect of the amount of light reflected by the ink solvent. A corrected density before liquid removal is determined on the basis of this corrected light amount.

In concrete terms, a light receiving unit capable of measuring light reflected at 45° and light reflected at 90° is provided, and the magnitude of the reflection component caused by the ink solvent in the 45° reflected light is measured. Correction for the reflection component caused by the ink solvent is carried out by using the 45° reflection component (the reflection component caused by the ink solvent) as a correction parameter for the 90° reflection component (the reflection component caused by the ink coloring material).

Figure 16:
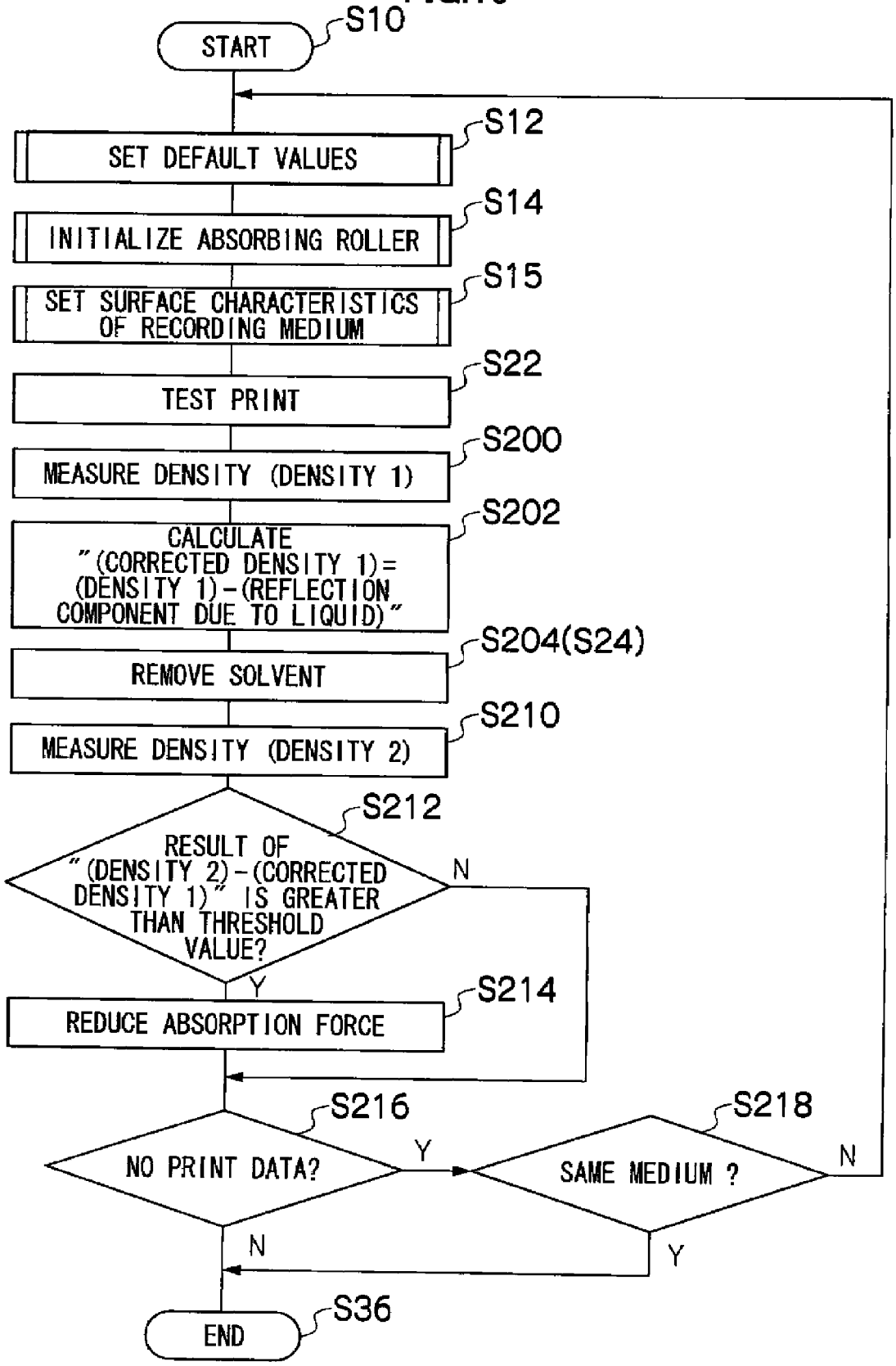
FIG. 16 is a flowchart showing a liquid removal capability setting control procedure according to the second embodiment of the present invention.

FIG. 16 shows a flowchart of liquid removal capability setting control for solvent removal in the inkjet recording apparatus 300. In FIG. 16, the steps which are the same as or similar to those in FIG. 8 are denoted with the same reference numerals and description thereof is omitted here.

Figure 17:
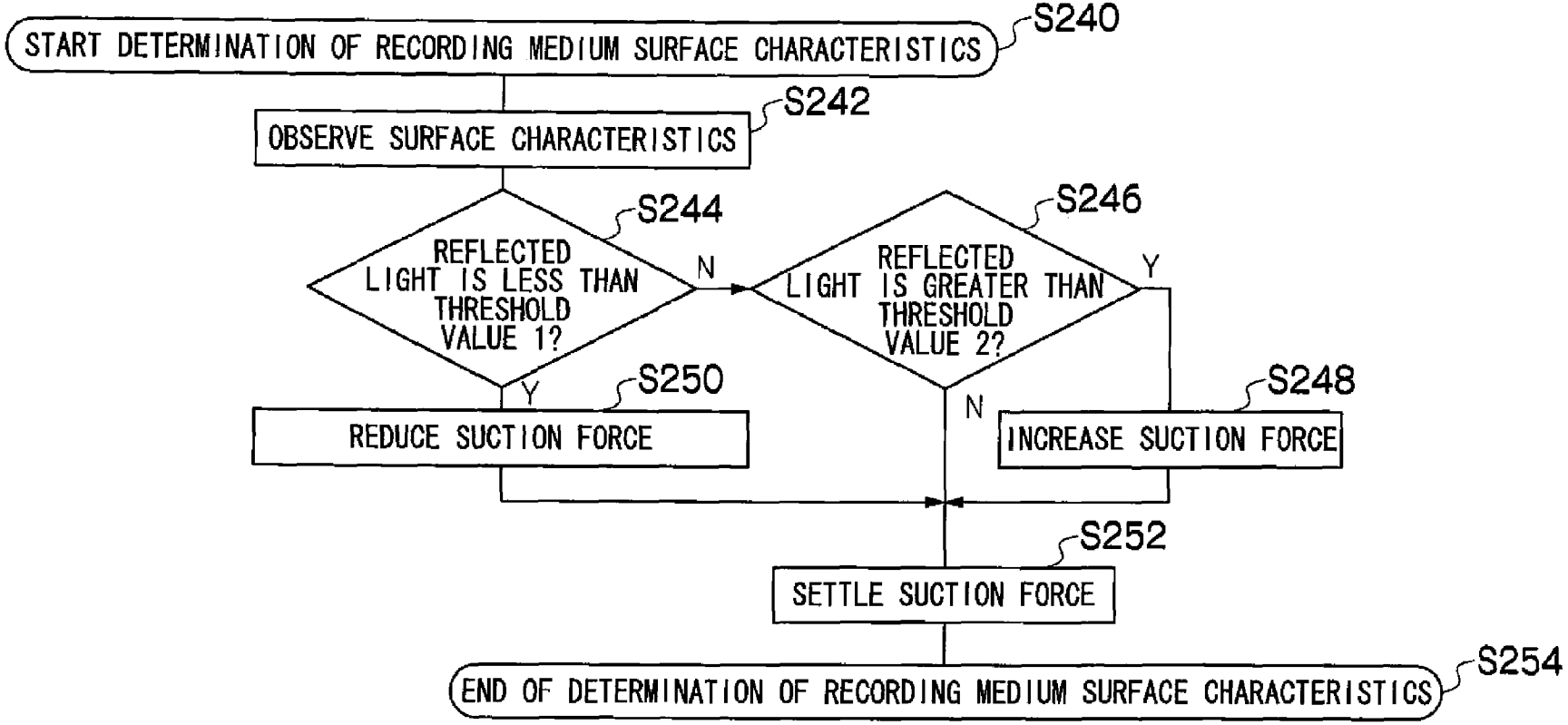
FIG. 17 is a flowchart showing a recording medium surface characteristics determination sequence of the liquid removal capability setting control procedure shown in FIG. 16.

In the liquid removal capability setting control shown in FIG. 16, after initializing the absorbing roller shown in FIG. 8 (step S12), the surface characteristics of the recording medium 16 are determined by using the surface characteristics sensor 122 shown in FIG. 14 (step S15). FIG. 17 shows the details of determining the surface characteristics of the recording medium 16 in step S15.

As shown in FIG. 17, when the determination of surface characteristics of the recording medium 16 is started (step S240), firstly, the surface characteristics of the recording medium 16 are observed by using the surface characteristics sensor 122 (step S242), and the amount of light reflected by the recording medium 16 (amount of reflected light) is compared with a prescribed threshold value (threshold value 1) (step S244). At step S244, if the amount of reflected light is not less than the threshold value 1 (NO verdict), then the procedure advances to step S246, and the amount of reflected light is compared with another prescribed threshold value (threshold value 2, where the threshold value 1<the threshold value 2).

At step S246, if the amount of reflected light is greater than the threshold value 2 (YES verdict), then the recording medium 16 is judged to have high smoothness, and control is implemented in order to increase the suction force of the suction device 108 (step S248). The suction force of the suction device 108 corrected at step S248 is settled (step S252), and the control procedure for determining the surface characteristics of the recording medium 16 then terminates (step S254).

If the amount of reflected light is not greater than the threshold value 2 at step S246 (NO verdict), then the suction force of the suction device 108 is settled without correcting the suction force of the suction device 108 on the basis of the surface characteristics of the recording medium 16 (step S252), and the procedure then advances to step S254.

On the other hand, at step S244, if the amount of reflected light is less than the threshold value 1 (YES verdict), then the recording medium 16 is judged to have low smoothness (in other words, a rough surface), and control is implemented in such a manner that the suction force of the suction device 108 is reduced (step S250). The suction force of the suction device 108 corrected at step S250 is settled (step S252), and the procedure then advances to step S254.

In other words, if the amount of reflected light is in a range between the threshold value 1, which is a lower limit value of the surface characteristics determination value, and the threshold value 2, which is an upper limit value of same, then the suction force of the suction device 108 is not corrected in accordance with the surface characteristics of the recording medium 16. On the other hand, if the amount of reflected light lies outside the range between the threshold value 1 and the threshold value 2, then the suction force of the suction device 108 is corrected in accordance with the surface characteristics of the recording medium 16. The determination of the surface characteristics of the recording medium 16 as shown in FIG. 17 (step S15 in FIG. 16) may also be carried out between step S14 and step S16 of the liquid removal capability setting procedure shown in FIG. 8.

When the suction force of the suction device 108 has been corrected by the process of determining the surface characteristics of the recording medium 16 as shown in FIG. 17 (in other words, when the corrected suction force has been settled in accordance with the determined surface characteristics), then a test print is created (step S22 in FIG. 16), and the procedure then advances to step S202.

At step S202, the ink coloring material density before liquid removal (density 1) is measured by means of the density meter 1. As described previously, the density meter 1 obtains a corrected density value (the corrected density 1 in FIG. 16). Thereupon, when liquid removal has been carried out (step S204), the ink coloring material density after liquid removal (density 2) is measured by means of the density meter 2 (step S210).

The density difference between the density 2 measured at step S210 and the corrected density 1 determined at step S202 is calculated, and this density difference is compared with a beforehand established threshold value (step S212). At step S212, if the density difference is not greater than the threshold value (NO verdict), then the procedure advances to step S216, where it is judged whether or not there is print data. If there is print data at step S216 (YES verdict), then the procedure advances to step S218, where it is judged whether or not the recording medium used for printing the print data is of the same type, and if the recording medium to be used in printing is a recording medium of a different type (NO verdict), then the procedure advances to step S12, whereas if it is the same type of recording medium (YES verdict), then the procedure advances to step S36, and the liquid removal capability setting control procedure terminates. If there is no print data at step S216 (NO verdict), then the procedure advances to step S36, and the liquid removal capability control procedure then terminates.

Figure 18:
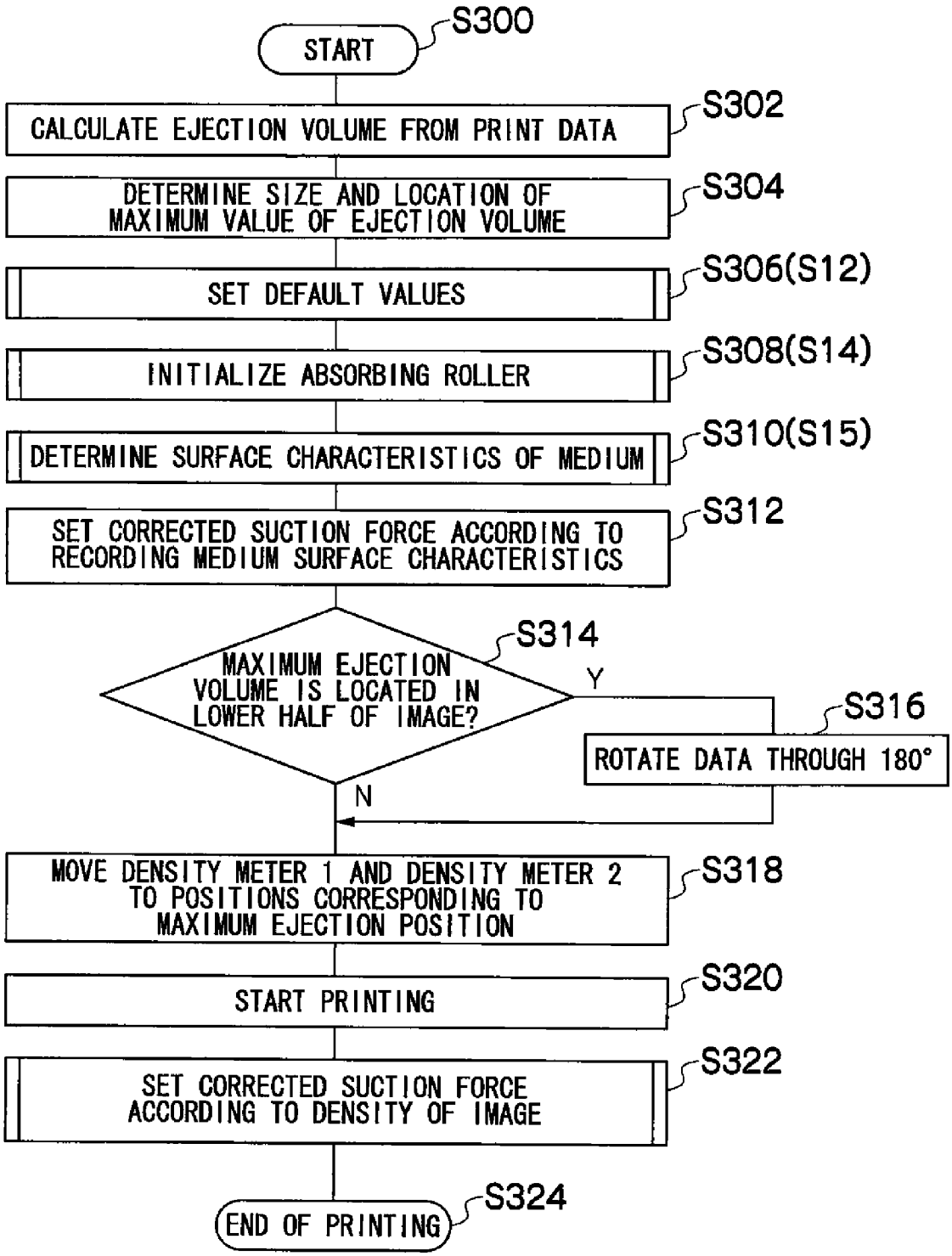
FIG. 18 is a flowchart showing a further mode of the liquid removal capability setting control procedure shown in FIG. 16.

Although the liquid removal capability control procedure is preferably carried out by using a test pattern, the liquid removal capability may also be controlled by using an actual image. FIG. 18 is a flowchart of a liquid removal capability control procedure during actual image printing. The present embodiment exemplifies a mode where the liquid removal capability of the absorbing roller 100 is controlled by altering the suction force of the suction device 108.

As shown in FIG. 18, when printing starts (step S300), the ejection volumes of the liquids (the ejection volumes of the treatment liquid and the ejection volumes of the ink) are calculated on the basis of the print data (step S302), and the maximum value of these liquid ejection volumes and the position of the maximum value are determined (step S304). Thereupon, the default value setting procedure shown in step S12 in FIG. 8 (step S306 in FIG. 18) and the initialization of the absorbing roller 100 shown in step S14 in FIG. 8 (step S308 in FIG. 18) are carried out, the surface characteristics determination procedure for the recording medium 16 shown in step S15 in FIG. 16 (step S310 in FIG. 18) is implemented, and a corrected suction force based on the surface characteristics of the recording medium 16 is set for the suction device 108, by taking the surface characteristics of the recording medium 16 into account (step S312).

Thereupon, it is judged whether the position of the maximum ejection volume is located in the lower half of the image (the trailing edge side in terms of the paper feed direction) or the upper half of the image (the leading edge side in terms of the paper feed direction) (step S314), and if the location of the position of the maximum ejection volume is judged to be in the lower half of the image (YES verdict), then the image is rotated through 180° (step S316), whereupon the procedure advances to step S318. On the other hand, if, at step S314, it is judged that the position of the maximum ejection volume is located in the upper half of the image (NO verdict), then the procedure advances to step S318.

In step S318, the density meters 1 and 2 are moved so as to correspond to the location of the position of the maximum ejection volume, and the procedure then advances to step S320, where an actual image is printed.

When performing liquid removal for removing the liquid on the recording medium 16, the suction force of the suction device 108 is set as shown in step S200 to step S214 in FIG. 16 (the suction force is corrected in accordance with the image density) (step S322 in FIG. 18), and when the prescribed image has been formed on the recording medium 16, the print control sequence terminates (step S324).

In the mode where the suction force of the suction device 108 is thus varied by observing the type of recording medium 16, since the recording medium 16, which is the final product, is directly observed, then there is little risk of supplying an image of degraded quality to the user, and furthermore, desirable liquid removal can be achieved by means of the apparatus having a simple composition.

Furthermore, in order to improve the beneficial effects, it is preferable that the thickness of the recording medium 16 is measured by using the thickness sensor 120 (shown in FIG. 15), and the clearance between the recording medium 16 and the absorbing roller 100 (in other words, the position of the absorbing roller 100 during liquid removal) is adjusted in accordance with the thickness of the recording medium 16.

Moreover, it is also possible to determine or select (preset) the type of recording medium 16, and to control the suction force (speed of rotation) of the suction device 108 (shown in FIG. 15) in accordance with the type of recording medium 16. It is possible to use the surface characteristics sensor 122 shown in FIG. 15, or the density meters 1 and 2, in order to determine the recording medium 16. In a mode where the density meters 1 and 2 are provided, it is possible to omit the surface characteristics sensor 122.

Adaptation Embodiment

Figure 19:
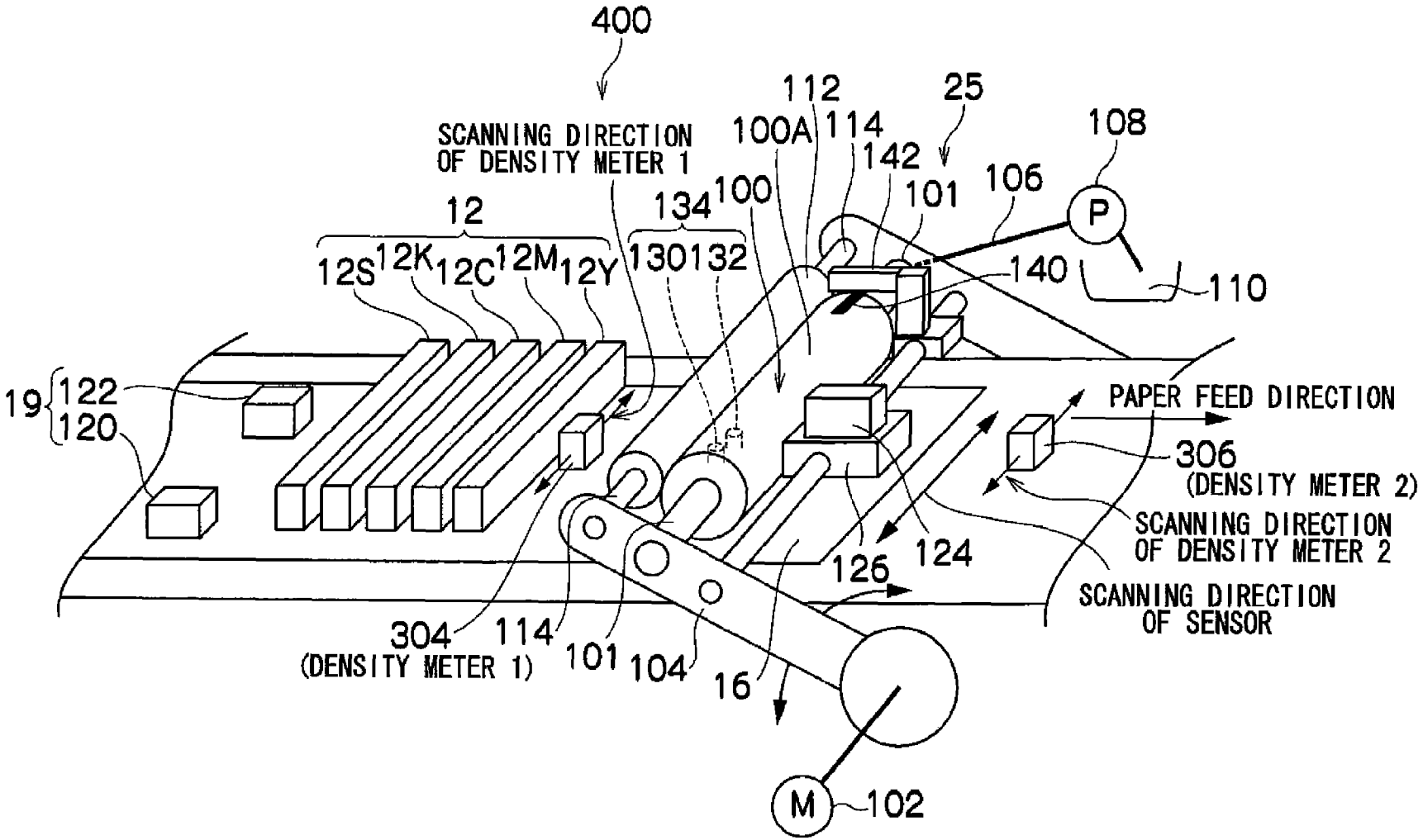
FIG. 19 is a principal schematic drawing showing a liquid removal unit in an inkjet recording apparatus according to an adaptation embodiment of the present invention.
Figure 20:
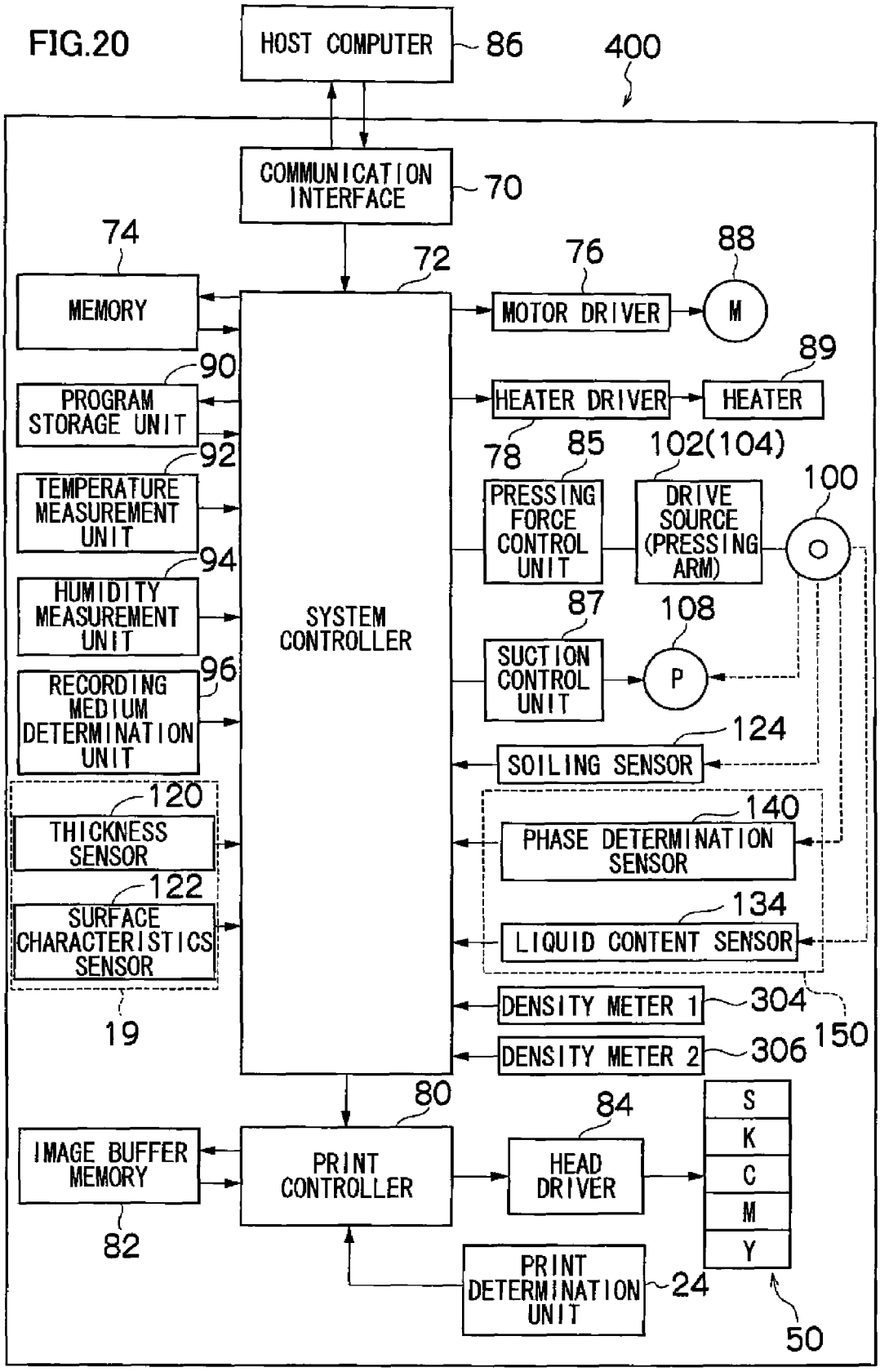
FIG. 20 is a principal block diagram showing the system configuration of the inkjet recording apparatus shown in FIG. 19.

Next, an adaptation embodiment of the first and second embodiments described above is explained. FIG. 19 is a principal schematic drawing showing the composition of a liquid removal unit 402 of an inkjet recording apparatus 400 according to the adaptation embodiment, and FIG. 20 is a principal block diagram showing the system composition of the inkjet recording apparatus 400. The overall composition of the inkjet recording apparatus 400 is similar to that of the inkjet recording apparatus 10 shown in FIG. 1, and here, a general description is omitted and those parts which are different to the inkjet recording apparatus 10 shown in FIG. 1 are described. Furthermore, parts in FIG. 19 which are the same as or similar to those in FIG. 3, and parts in FIG. 20 which are the same as or similar to those in FIG. 7 are denoted with the same reference numerals and description thereof is omitted.

As shown in FIG. 19 and the inkjet recording apparatus 400 comprises the soiling sensor 124, which observes the surface of the absorbing roller 100, the liquid volume measurement unit 150 (shown in FIG. 20), which measures the amount of liquid contained in the absorbing roller 100, and the density meters 1 and 2, which measure the density of the ink coloring material on the recording medium 16.

In the inkjet recording apparatus 400 having this composition, when printing an actual print, the suction force of the suction device 108 (or the pressing force of the absorbing roller 100) is adjusted by measuring the density of the ink coloring material on the recording medium 16, and at the same time, the surface state of the absorbing roller 100 and the liquid content of the absorbing roller 100 are determined at prescribed intervals, and these determination results are added up to predict the cleaning timing for the absorbing roller 100, and the replacement timing for the absorbing roller 100 and the cleaning roller 112. The results of these predictions are reported to the user. By combining the use of the device which observing the absorbing roller 100 and the device which observing the recording medium 16 in this way, it is possible to achieve highly efficient liquid removal, while also improving the maintenance properties of the liquid removal unit 25.

Further Embodiments

The one treatment liquid ejection head 12S is disposed at the furthest upstream position of the print unit 12 (see FIG. 1) in the above-described embodiments; however, in implementing the present invention, the arrangement of the treatment liquid ejection head is not limited to this, and it is also possible to adopt a composition in which a treatment liquid ejection head is appended at least one position between the color ink ejection heads in the print unit 12.

Furthermore, an ejection head based on an inkjet method is used as the device for applying treatment liquid in the embodiments described above, but instead of or in combination with this, it is also possible to use a device which applies treatment liquid to the recording medium 16 by using a contacting member, such as a roller, brush, blade, or the like.

In the above-described embodiments, the treatment liquid ejection head 12S which ejects one type of treatment liquid is shown, but it is also possible to compose the treatment liquid ejection head 12S from a plurality of heads, or to use a composition in which treatment liquid of two or more types can be ejected selectively. Furthermore, the mode is shown in which one type of ink is provided in the inkjet recording apparatus 10 (300, 400) in the above-described embodiments, but it is also possible to adopt a composition in which a plurality of heads are provided in such a manner that inks of a plurality of types can be ejected selectively.

In the above-described embodiments, the inkjet recording apparatus using the page-wide full line type heads having the nozzle rows of the length corresponding to the entire width of the recording medium 16 is described, but the scope of application of the present invention is not limited to this, and the present invention may also be applied to an inkjet recording apparatus using a shuttle head which performs image recording while moving a recording head of short dimensions, in a reciprocal fashion.

In the above-described embodiments, the absorbing roller 100 has a length corresponding to the width of the recording medium 16 in the lengthwise direction, but it is also possible to adopt a composition where the absorbing roller 100 has a structure which is divided in the lengthwise direction thereof, in such a manner that liquid removal can be performed independently by means of each divided portion of the absorbing roller 100. In this case, the absorbing roller 100 can be controlled finely in accordance with the distribution of solvent on the recording medium 16, and moreover, improved maintenance characteristics can be expected in the absorbing roller 100.

In the above-described embodiments, the inkjet recording apparatus for forming images on a recording medium 16 by ejecting ink from nozzles provided in print heads is described, but the scope of application of the present invention is not limited to this, and it may also be applied broadly to image forming apparatuses which form images (three-dimensional shapes) by means of liquids other than ink, such as resist, or to liquid ejection apparatuses, such as dispensers, which eject liquid chemicals, water, or the like, from nozzles (ejection holes).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which ejects liquid onto a recording medium to form a desired image on the recording medium;

a conveyance device which moves at least one of the recording medium and the ejection head so as to move the recording medium in a conveyance direction relatively to the ejection head;

a first density determination device which determines density of the image formed on the recording medium and is arranged on a downstream side of the ejection head in the conveyance direction;

a liquid removal device which performs liquid removal to remove the liquid on the recording medium and is arranged on a downstream side of the first density determination device in the conveyance direction;

a second density determination device which determines the density of the image from which a portion of the liquid has been removed by the liquid removal device, the second density determination device being arranged on a downstream side of the liquid removal device in the conveyance direction; and a liquid removal control device which implements control to adjust a liquid removal capability of the liquid removal device according to determination results of the first density determination device and the second density determination device.

2. The image forming apparatus as defined in claim 1, further comprising:

a processing device which calculates a density difference between the density of the image after the liquid removal as obtained by the second density determination device and the density of the image before the liquid removal as obtained by the first density determination device, wherein the liquid removal control device implements the control to adjust the liquid removal capability of the liquid removal device according to the density difference calculated by the processing device.

3. The image forming apparatus as defined in claim 1, further comprising:

a recording medium determination device which determines a type of the recording medium, wherein the liquid removal control device implements the control to adjust the liquid removal capability of the liquid removal device according to the type of the recording medium determined by the recording medium determination device.

4. The image forming apparatus as defined in claim 1, further comprising:

a maximum ejection region determination device which determines a maximum ejection region where a liquid ejection volume is a maximum on the image, according to data of the image to be formed on the recording medium; and an image formation control device which implements control to carry out image formation from a trailing edge side of the image to a leading edge side thereof in the conveyance direction, if the maximum ejection region is situated a side of the trailing edge from a central region of the image.

5. The image forming apparatus as defined in claim 1, wherein:

the liquid removal device comprises a suction device which suctions the liquid; and the liquid removal control device implements the control to adjust the liquid removal capability of the liquid removal device by adjusting a suction force of the suction device.

6. The image forming apparatus as defined in claim 1, wherein:

the liquid removal device comprises: an absorption device which absorbs and removes the liquid on the recording medium by making contact with the liquid on the recording medium; and a movement device which moves the absorption device in a direction having a component in a direction substantially perpendicular to a recording surface of the recording medium; and the liquid removal control device implements the control to adjust the liquid removal capability of the liquid removal device by adjusting a pressing force of the absorption device against the recording medium by adjusting a position of the absorption device by the movement device.

7. An inkjet recording apparatus, comprising the image forming apparatus as defined in claim 1.

8. The inkjet recording apparatus as defined in claim 7, wherein the ejection head includes:

an inkjet head which ejects ink forming the image onto the recording medium; and a treatment liquid ejection head which ejects treatment liquid which fixes the ink on the recording medium by reacting with the ink.

* * * * *